US006378603B1

(12) United States Patent
Shimoya et al.

(10) Patent No.: US 6,378,603 B1
(45) Date of Patent: Apr. 30, 2002

(54) HEAT EXCHANGER CONSTRUCTED BY PLURAL HEAT CONDUCTIVE PLATES

(75) Inventors: Masahiro Shimoya, Kariya; Yoshiyuki Yamauchi, Chita-gun, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/455,610

(22) Filed: Dec. 7, 1999

Related U.S. Application Data

(63) Continuation of application No. 09/116,383, filed on Jul. 16, 1998, now Pat. No. 6,047,769.

(30) Foreign Application Priority Data

| | | |
|---|---|---|
| Jul. 17, 1997 | (JP) | 9-192922 |
| Feb. 5, 1998 | (JP) | 10-24842 |
| Jul. 7, 1998 | (JP) | 10-192077 |

(51) Int. Cl.[7] ..... F28D 1/03
(52) U.S. Cl. ..... 165/153; 165/148
(58) Field of Search ..... 165/148, 153, 165/176

(56) References Cited

U.S. PATENT DOCUMENTS

| | | | | |
|---|---|---|---|---|
| 3,258,832 A | | 7/1966 | Gerstung | |
| 4,011,905 A | | 3/1977 | Millard | 165/153 X |
| 4,249,597 A | | 2/1981 | Carey | |
| 4,932,469 A | | 6/1990 | Beatenbough | 165/153 |
| 5,042,577 A | | 8/1991 | Suzumura | |
| 5,050,671 A | | 9/1991 | Fletcher | 165/148 X |
| 5,152,337 A | | 10/1992 | Kawakatsu et al. | 165/153 |
| 5,692,559 A | | 12/1997 | Cheong | 165/148 |
| 5,735,343 A | | 4/1998 | Kajikawa et al. | 165/153 |
| 5,850,872 A | * | 12/1998 | Cesaroni | 165/41 |
| 5,960,859 A | * | 10/1999 | Sakurai | 165/43 |
| 6,047,769 A | * | 4/2000 | Shimoya et al. | 165/153 |

FOREIGN PATENT DOCUMENTS

| | | |
|---|---|---|
| DE | 43 08 858 A1 | 9/1994 |
| EP | 0 710 808 A1 | 5/1996 |
| JP | A-7-260384 | 10/1995 |
| WO | 38700 | 12/1996 |

* cited by examiner

*Primary Examiner*—Leonard Leo
(74) *Attorney, Agent, or Firm*—Harness, Dickey & Pierce, PLC

(57) ABSTRACT

A pair of heat conductive plates forming an evaporator core portion has a plurality of projection ribs. The projection ribs protrude toward outsides of the pair of heat conductive plates for forming refrigerant passages thereinside. Air flows outside the heat conductive plate perpendicularly to a flow direction of the refrigerant, and is prevented from flowing straightly by the projection ribs to make a turbulent flow.

5 Claims, 20 Drawing Sheets

HEAT EXCHANGER CONSTRUCTED BY PLURAL HEAT CONDUCTIVE PLATES

CROSS REFERENCE TO RELATED APPLICATION

This is a continuation of U.S. patent application Ser. No. 09/116,383, filed Jul. 16, 1998, now U.S. Pat. No. 6,047,769.

This application is based on and incorporates herein by reference Japanese Patent Application Nos. Hei. 9-192922 filed on Jul. 17, 1997, Hei. 10-24842 filed on Feb. 5, 1998, and Hei. 10-192077 filed on Jul. 7, 1998.

BACKGROUND OF THE INVENTION

1. Field of the Invention

The present invention relates to a heat exchanger constructed by a plurality of plates forming inside fluid passages through which an inside fluid flows, and applicable to a refrigerant evaporator for a vehicle air conditioning apparatus.

2. Description of Related Art

Conventionally, as shown in FIGS. 28, 29A and 29B, a refrigerant evaporator for a vehicle air conditioning apparatus is constructed by laminating alternately a plurality of oval flat tubes and corrugated fins having louvers to increase an air side heat conductive area. Each oval flat tube is formed by connecting a pair of plates facing each other at the outer peripheries thereof. An assembling process of this heat exchanger becomes complicated because the corrugated fin is disposed between the adjacent oval flat tubes. That is, as the conventional heat exchanger needs a corrugated fin, it is. difficult to reduce the manufacturing cost and the size of the heat exchanger.

In the air conditioning unit, the evaporator is generally formed into rectangular parallelopiped shape, as shown in FIG. 28. This is because it is difficult to form the outer shape of the corrugated fin into any shapes other than the rectangular parallelopiped shape for the reason that the corrugated fin is formed by press-forming a thin coil-like material into waved shape as shown in FIGS. 29A and 29B. As a result, the evaporator must be formed into the rectangular parallelopiped shape along the outer shape of the corrugated fin.

SUMMARY OF THE INVENTION

An object of the present invention is to provide a heat exchanger, which is constructed by only a heat conductive plate forming an inside fluid passage while dispensing with fin-members such as a corrugated fin and attaining a sufficient heat transmitting performance.

According to the present invention, a pair of heat conductive plates forming a heat-exchanging core portion has a plurality of projection ribs. The projection ribs protrude outwardly from the pair of heat conductive plates for forming inside fluid passages therein. An outside fluid flows outside the heat conductive plate perpendicularly to a flow direction of an inside fluid, and is prevented from flowing straightly by the projection ribs.

Thus, the outside fluid makes a turbulent flow, thereby further improving the outside fluid side heat transmitting efficiency. As a result, a desired heat-exchanging performance can be attained without providing a fin member at the outside fluid side. That is, the heat exchanger can be constructed by only the heat conductive plate having the projection ribs forming the inside fluid passages. Thereby the total cost for manufacturing the heat exchanger and the size of the same are reduced. Further, because the rigidity of the entire heat exchanger is increased, the heat conductive plate can be made thin, and the total cost and size of the heat exchanger is further reduced.

Further, the heat exchanger is constructed by only the heat conductive plate, the heat-exchanging core portion may be formed into a rectangular parallelopiped shape having a triangular protrusion portion. The volume of the heat-exchanging core portion is increased by adding the protrusion portion, thus the heat-exchanging performance of the heat exchanger is improved. When the heat exchanger is used as a refrigerant evaporator installed within an air conditioner casing, the protrusion portion can be formed by using an affordable space inside the air conditioner casing.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

First Embodiment

A first embodiment will be described with reference to FIGS. 1–6. A heat exchanger of the present invention is applied to a refrigerant evaporator 10 for a vehicle air conditioning apparatus. In the evaporator 10, an air-flow direction A of air to be conditioned crosses a refrigerant-flow direction B perpendicularly. The evaporator 10 includes a core portion 11 carrying out heat exchange between the air to be conditioned (external fluid) and the refrigerant (internal fluid), which is constructed by stacking a plurality of heat conductive plates 12.

Figure 2:
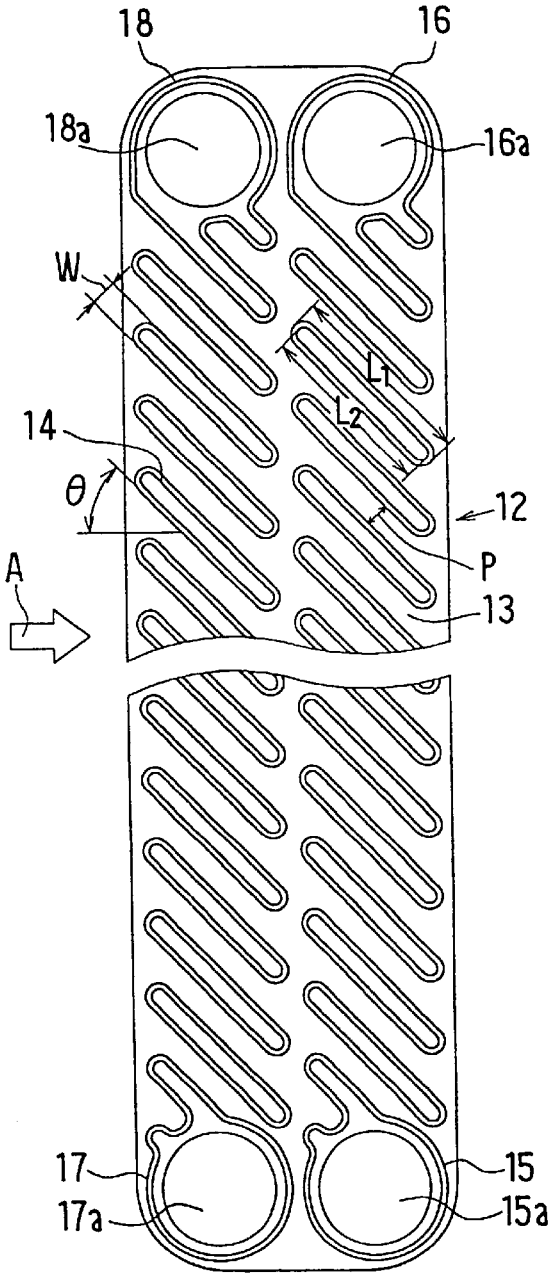
FIG. 2 is a plan view showing a heat conductive plate according to the first embodiment.

For each heat conductive plate 12, brazing sheet (thickness: about 0.25 mm) obtained by cladding an aluminum brazing material (for example A4000) on the two surfaces of an aluminum core material (for example A3000) is used. The brazing sheet is press-formed into a rectangular shape as shown in FIG. 2. The longitudinal length is about 245 mm, and the latitudinal length is about 45 mm.

As shown in FIG. 2, the heat conductive plate 12 has a plurality of rectangular-shaped projection ribs 14 protruded from the flat plate 13 of the heat conductive plate 12. Each projection rib 14 forms a refrigerant, passage (inside fluid passage) through which the low-pressure refrigerant having passed through a pressure reducing device, such as an expansion valve, of a refrigeration cycle flows. The projection rib 14 inclines with respect to the air flow direction A by a predetermined angle θ (for example, 45°), and is formed long and narrow.

Figure 4:
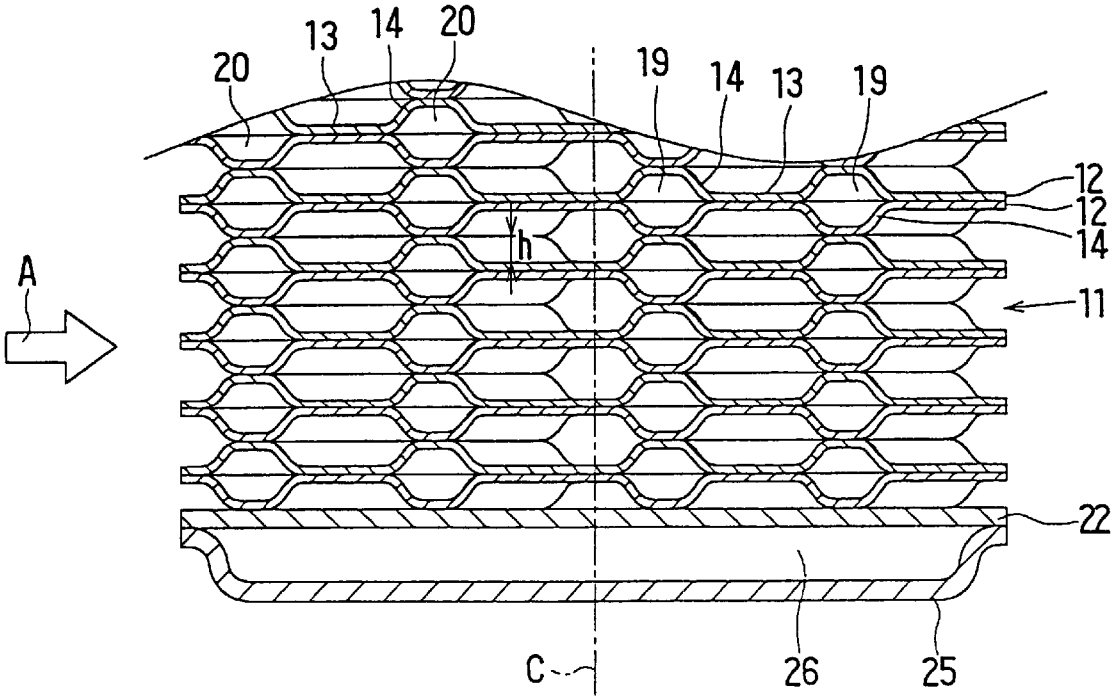
FIG. 4 is a cross-sectional view taken along line IV—IV line in FIG. 3.
Figure 5:
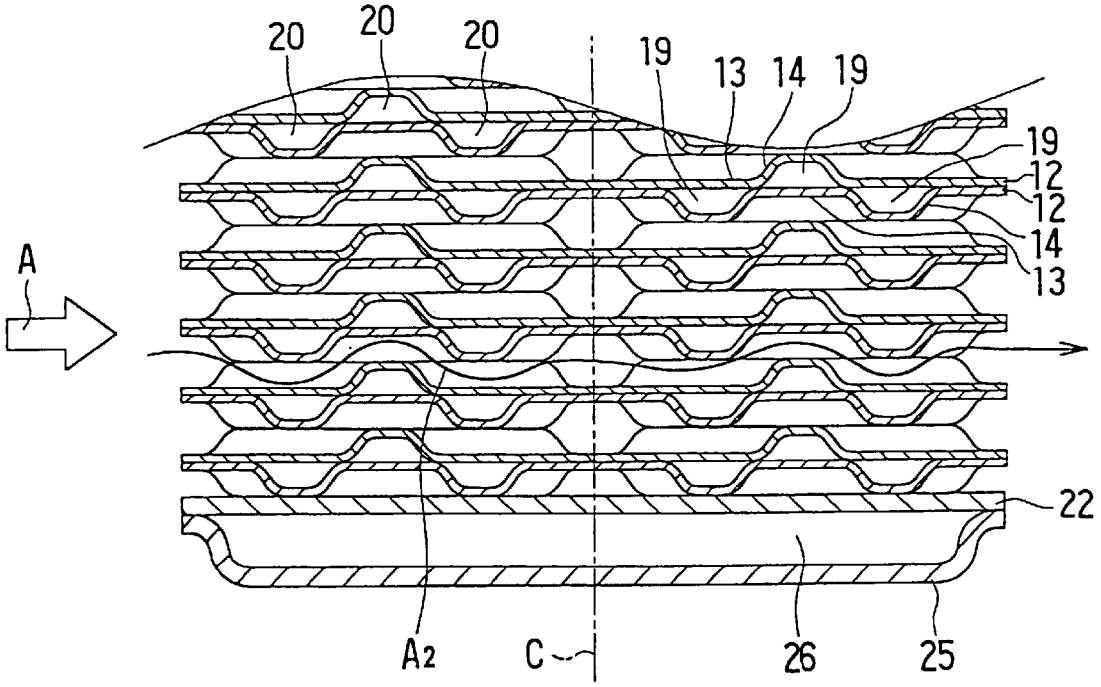
FIG. 5 is a cross-sectional view taken along line V—V in FIG. 3.

The projection rib 14 is, as shown in FIGS. 4 and 5. formed into a substantially trapezoidal shape. In the present embodiment, for example, the projection height h is 1.5 mm, the longitudinal bottom length L1 is 28.4. mm, the longitudinal top length L2 is 26.1 mm, the pitch P between the adjacent projection ribs 14 is 7 mm, and the width W of the projection rib 14 is 3.6 mm.

Referring back to FIGS. 1 and 2, the plurality of projection ribs 14 are arranged in two rows, and construct two projection rib groups arranged in parallel in the air flow direction.

Figure 1:
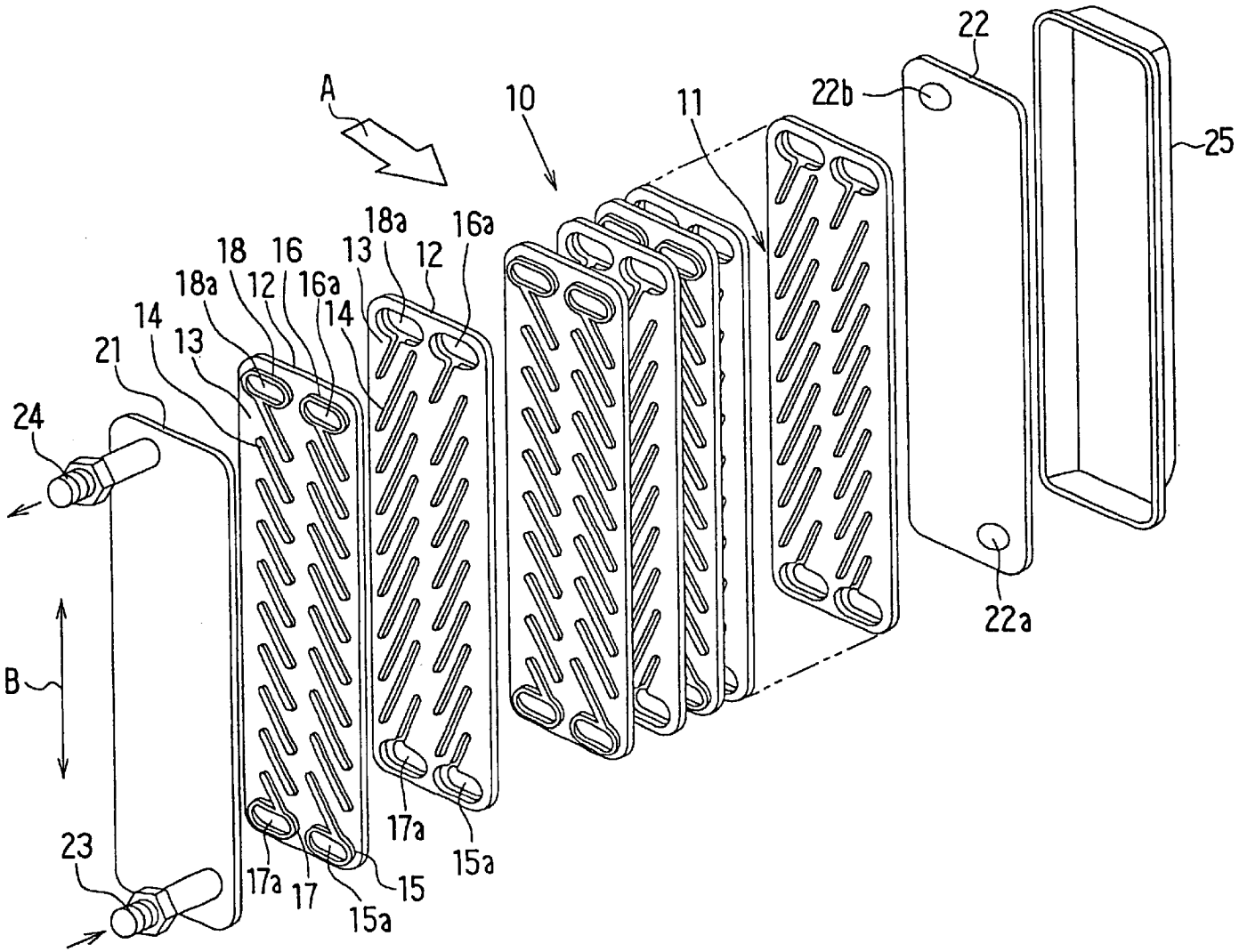
FIG. 1 is a perspective exploded view showing a refrigerant evaporator according to a first embodiment.
Figure 3:
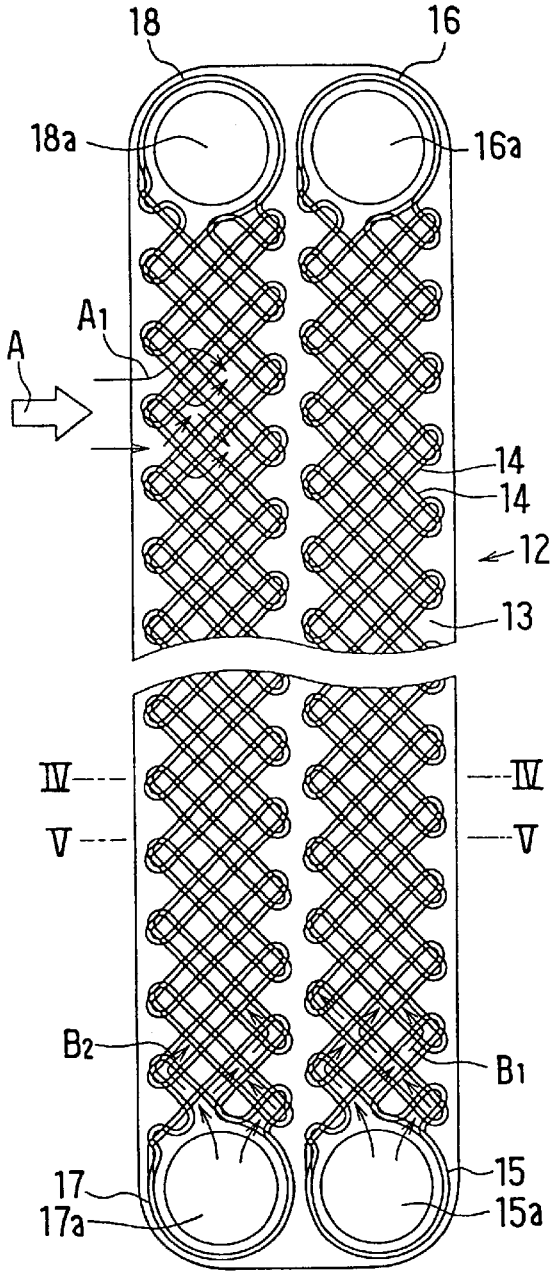
FIG. 3 is a plan view showing a pair of heat conductive plates connected to each other in the first embodiment.

The heat conductive plate 12 includes two upper tank portions 16, 18 and two lower tank portions 15, 17 at both ends in the longitudinal direction thereof. These tank portions 15, 16, 17, 18 are arranged to correspond to the two projection rib groups. The tank portions 15–18 are formed into a circular shape as shown in FIGS. 2 and 3, or formed into a oval shape as shown in FIG. 1, and protrude toward the same direction as the projection rib 14. The tank portion 15–18 includes communication holes 15*a*–18*a* in the center portions thereof respectively. The communication holes 15*a*, 16*a*, 17*a*, 18*a* make refrigerant passages described later communicate with each other.

Among the plurality of projection ribs 14, the projection ribs 14 being adjacent to the tank portions 15–18 are formed in such a manner that the concave spaces thereinside communicate with the concave spaces of the tank portions 15–18.

As shown in FIGS. 1, 4 and 5, the plural heat conductive plates 12 are stacked in such a manner that the concave portions and convex portions of the tank portions 15–18 respectively face to each other. Here, in a pair of heat conductive plates 12 in which the concave portions thereof face to each other, as shown in FIG. 3, the rectangular shaped projection ribs 14 of each plate 12 inclines to the opposite direction to intersect each other.

The inside spaces of the plural projection ribs 14 communicate with each other at the intersections between the pair of projection ribs 14, and form an air downstream side refrigerant passage 19 and an air upstream side refrigerant passage 20 (FIGS. 4 and 5). Here, the air downstream side refrigerant passage 19 communicates with the air downstream side tank portions 15, 16. The air upstream side refrigerant passage communicates with the air upstream side tank portions 17, 18.

In this way, in the present embodiment, the refrigerant passages 19, 20, through which the refrigerant flows in the longitudinal direction B of the heat conductive plate 12, are formed by the two projection rib groups.

The two projection rib groups are partitioned by a connecting portion between the flat plates 13, which is located at the center portions C of the pair of heat conductive plates 12 in the width direction thereof. Here, arrows B1, B2 in FIG. 3 denote the refrigerant flows in the refrigerant passages 19, 20 and an arrow A1 denotes the air-flow passing through gaps between the projection ribs 14 at the outside of the heat conductive plates 12.

The core portion 11 is constructed by stacking the plural pair of heat conductive plates 14 forming the refrigerant passages 19, 20.

As shown in FIG. 1, end plates 21, 22 having the sane sizes as the heat conductive plate 12 are provided at both ends of the stacked heat conductive plates 12. The end plate 21, 22 are also made of a brazing sheet obtained by cladding an aluminum brazing material (for example A4000) on the two surfaces of an aluminum core material (for example A3000). The thickness of the end plates 21, 22 is thicker than that of the heat conductive plate 12 (for example, thickness: 1.0 mm) for increasing the rigidity.

The end plates 21, 22 are formed into flat plate and connect to the outermost heat conductive plates 12 while contacting the convex surfaces of the heat conductive plates 12. As shown in FIG. 1, a refrigerant inlet pipe 23 and a refrigerant outlet pipe 24 are connected to the left side end plate 21. The refrigerant inlet pipe 23 communicates with the air downstream side lower tank portion 15. The refrigerant outlet pipe 24 communicates with the air upstream side upper tank portion 18. Gas-liquid phase refrigerant pressure-reduced in the pressure-reducing device (not illustrated)

flows into the refrigerant inlet pipe. 23. The refrigerant outlet pipe 24 is connected to the suction side of a compressor (not illustrated), and introduces the gas refrigerant evaporated in the evaporator 10 into the compressor.

Further, in the right side end plate 22 in FIG. 1, a lower communication hole 22*a* and an upper communication hole 22*b* are formed, The communication hole 22*a* communicates with the air downstream side lower tank portion 15. The communication hole 22*b* communicates with the air upstream side upper tank portion 18. Further, a side plate 25 is connected to the outside surface of the right side end plate 22. The side plate 25 is press-formed concave like, and made of brazing sheet obtained by cladding an aluminum brazing material (A4000) on the two surfaces of an aluminum core material (A3000). The side plate 25 is thickened to about 1.0 mm for increasing the rigidity thereof.

The concave portion of the side plate 25 and the end plate 22 form a refrigerant passage 26 (FIGS. 4 and 5) therebetween by connecting to each other. The refrigerant passage 26 makes the air downstream side lower tank portion 15 communicate with the air upstream side upper tank portion 18 through the communication holes 22*a*, 22*b*.

Figure 6:
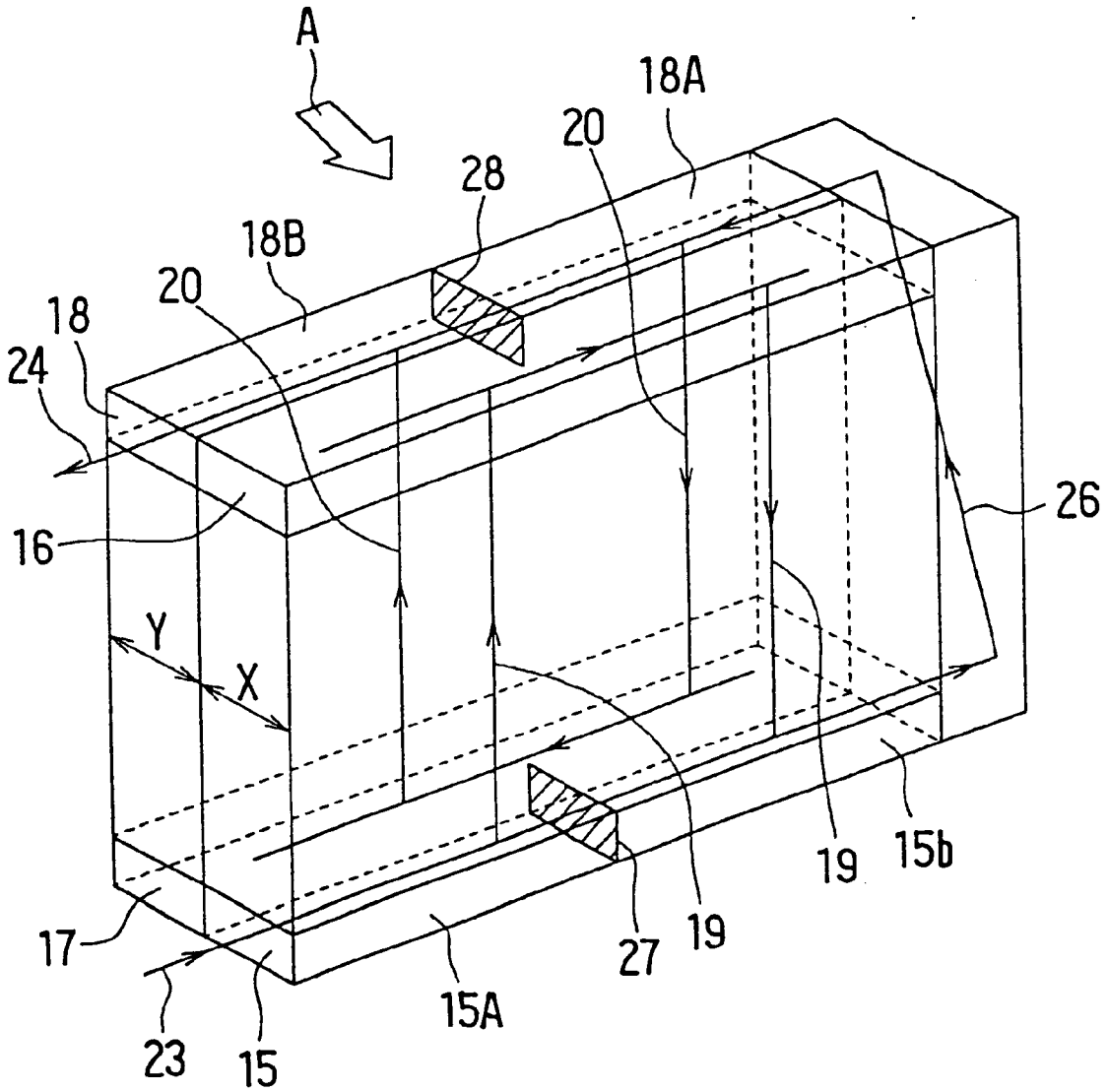
FIG. 6 is a perspective schematic view showing a layout of refrigerant passages in the first embodiment.

FIG. 6 shows a refrigerant passage layout in the refrigerant evaporator 10 schematically. As shown in FIG. 6, the air downstream side tank portions 15, 16 construct a refrigerant inlet side tank portion, and the air upstream side tank portions 17, 18 construct a refrigerant outlet side tank portion.

The air downstream side refrigerant passage 19 which communicate with the refrigerant inlet side tank portions 15, 16 construct a refrigerant inlet side heat-exchanging portion X. The air upstream side refrigerant passages 20 which communicate with the refrigerant outlet side tank portions 17, 18 construct a refrigerant outlet side heat-exchanging portion Y.

A partition member 27 is provided at the center position of the refrigerant inlet side lower tank portion 15 in the stacking direction of the heat conductive plate 12. The partition member 27 partitions the refrigerant inlet side lower tank portion 15 into a left side first area 15A and a right side second area 15B. In a similar way, a partition member 28 is provided at the center position of the refrigerant outlet side upper tank portion 18. The partition member 28 partitions the refrigerant outlet side upper tank portion 18 into a right side first area 18A and a left side second area 18B.

The partition members 27, 28 are provided by closing the communication holes 15*a*, 18*a* in the tank portions 15, 18 of the heat conductive plate 12 which is located at the center position.

In this refrigerant evaporator 10, the gas-liquid phase refrigerant flows into the first area 15A of the refrigerant inlet side lower tank portion 15 through the refrigerant inlet pipe 23. The refrigerant flows from the first area 15A, and in the air downstream side refrigerant passage 19 upwardly into the refrigerant inlet side upper tank portion 16. The refrigerant flows in the refrigerant inlet side upper tank portion 16 toward the right side, and flows in the air downstream side refrigerant passage 19 downwardly into the second area 15B of the refrigerant inlet side lower tank portion 15.

Next, the refrigerant flows from the second area 15B, through the refrigerant passage 26, and into the first area 18A of the refrigerant outlet side upper tank portion 18. The refrigerant flows from the first area 18A, and in the air upstream side refrigerant passages 20 downwardly into the refrigerant outlet side lower tank portion 17. The refrigerant flows in the refrigerant outlet side lower tank 17 toward the left side, and flows in the air upstream side refrigerant passages 20 upwardly into the second area 18B of the refrigerant outlet side upper tank portion 18. Finally, the refrigerant flows from the second area 18B and out of the evaporator 10 through the refrigerant outlet pipe 24.

In the present embodiment, each constructing members shown in FIG. 1 are stacked to be connected to each other. The stacked assembly is carried into a brazing furnace while being supported by a jig, and heated to the melting point of the brazing material. In this way, the stacked material is brazed integrally, and assembling the evaporator 10 is completed.

Next, an operation of the refrigerant evaporator 10 in the present embodiment will be described. The gas-liquid phase refrigerant in the lower pressure side of the refrigeration cycle flows in accordance with the above-described refrigerant route as shown in FIG. 6. The air to be conditioned winds and flows, as denoted by an arrow A2 in FIG. 5, in spaces formed between the projection ribs 14 protruded from the outside surfaces of the heat conductive plates 12. The refrigerant absorbs a latent heat from the air and evaporates, thus the air is cooled.

Here, a refrigerant flow direction in the refrigerant inlet side heat-exchanging portion X is set the same as in the refrigerant outlet side heat-exchanging portion Y. That is, the refrigerant flows upwardly in both heat-exchanging portions X, Y at the left side of the partition members 27, 28 in FIG. 6, and the refrigerant flows downwardly in both heat-exchanging portions X, Y at the right side of the partition members 27, 28.

Thus, even when the gas-liquid phase refrigerant is distributed into the refrigerant passages 19, 20 non-uniformly to some extent, the temperature of air passing through the core portion 11 is made uniform in the entire evaporator 10.

As shown in FIG. 3, the refrigerant passages 19, 20 are formed by the rectangular-shaped projection ribs 14 of the couple of heat conductive plates 12 the concave surfaces of which face to each other. Thus, as denoted by arrows B1, B2 in FIG. 3, the refrigerant complicatedly winds in the plane direction of the heat conductive plate 12 in the refrigerant passages 19, 20. Further, as is understood from FIG. 5, the refrigerant winds also in the stacking direction of the heat conductive plate 12.

Therefore, the refrigerant flows in the refrigerant passages while changing the flow direction thereof in three dimensions. Namely, the refrigerant makes a turbulent flow, thereby further improving the refrigerant side heat transmitting efficiency.

The air passing through the core portion 11 flows perpendicularly to the refrigerant flow direction B in the core portion 11. The rectangular-shaped projection ribs 14 having inclination angles θ of 45° form heat transmitting surfaces in which the projection ribs 14 intersect with each other. Thus, the air flows along this heat transmitting surfaces and is prevented from flowing straightly. Therefore, as denoted by the arrow A1 in FIG. 3, the air complicatedly winds and flows in the plane direction of the heat conductive plate 12. At the same time, as denoted by the arrow A2 in FIG. 5, the air winds and flows in the stacking direction of the heat conductive plate 12.

As a result, the air flows in the air passages formed by gaps between the convex surfaces of the projection ribs 14 protruded from the outside surface of the heat conductive plates 12 while changing the flow direction thereof in three dimensions. Namely, the air also makes a turbulent flow, thereby further improving the air side heat transmitting efficiency. Here, the air side heat transmitting area is much smaller than that in a conventional evaporator including fin members, because the core portion 11 is constructed by only the heat conductive plates 12. However, as the air side heat transmitting efficiency is further improved by making the turbulent air flow, the reduction of the air side heat transmitting area can be filled by the improvement of the air side heat transmitting efficiency. As a result, a desired cooling performance can be attained.

Second Embodiment

Figure 7:
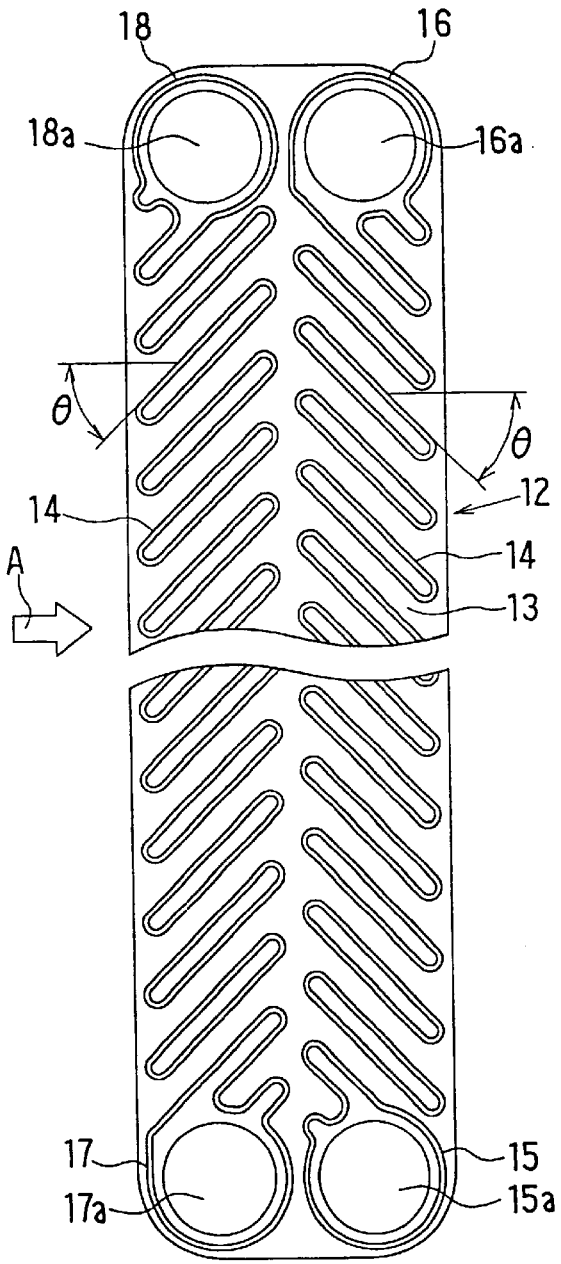
FIG. 7 is a plan view showing a heat conductive plate according to a second embodiment.
Figure 8:
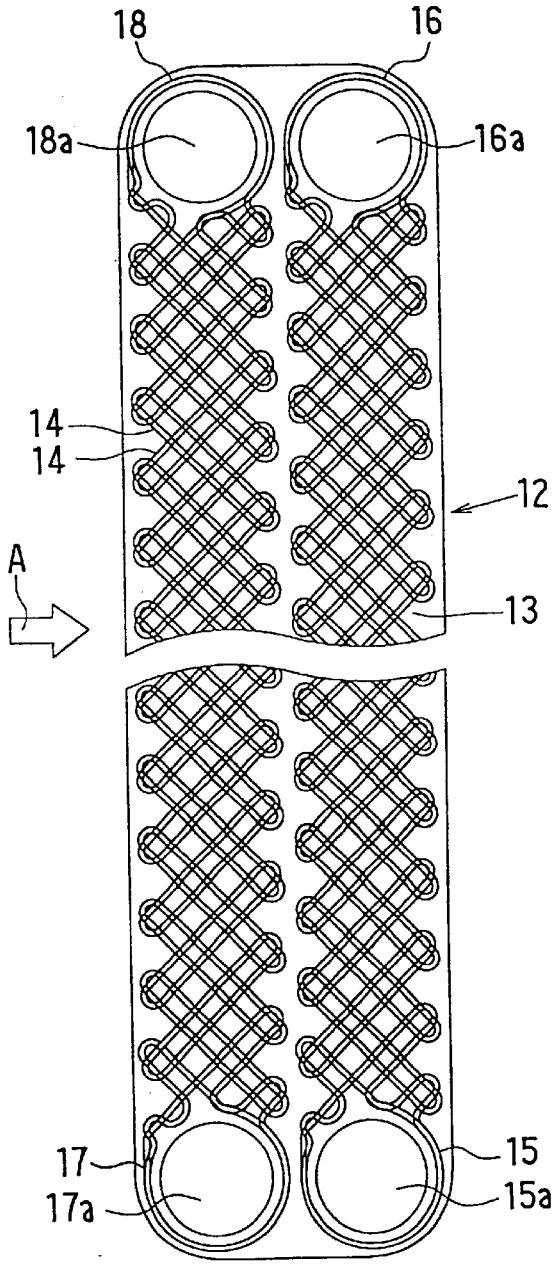
FIG. 8 is a plan view showing a pair of heat conductive plates connected to each other in the second embodiment.

According to a second embodiment, as shown in FIGS. 7 and 8, the projection ribs 14 arranged at the air upstream side and the projection ribs 14 arranged at the air downstream side incline toward the opposite direction to each other.

Third Embodiment

Figure 9:
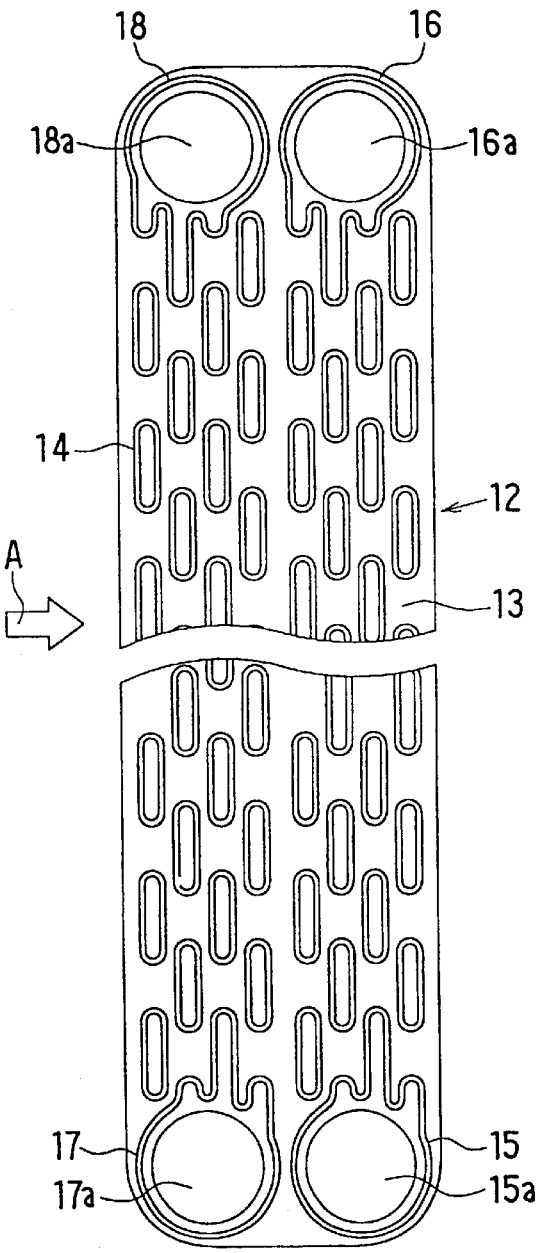
FIG. 9 is a plan view showing a heat conductive plate according to a third embodiment.
Figure 10:
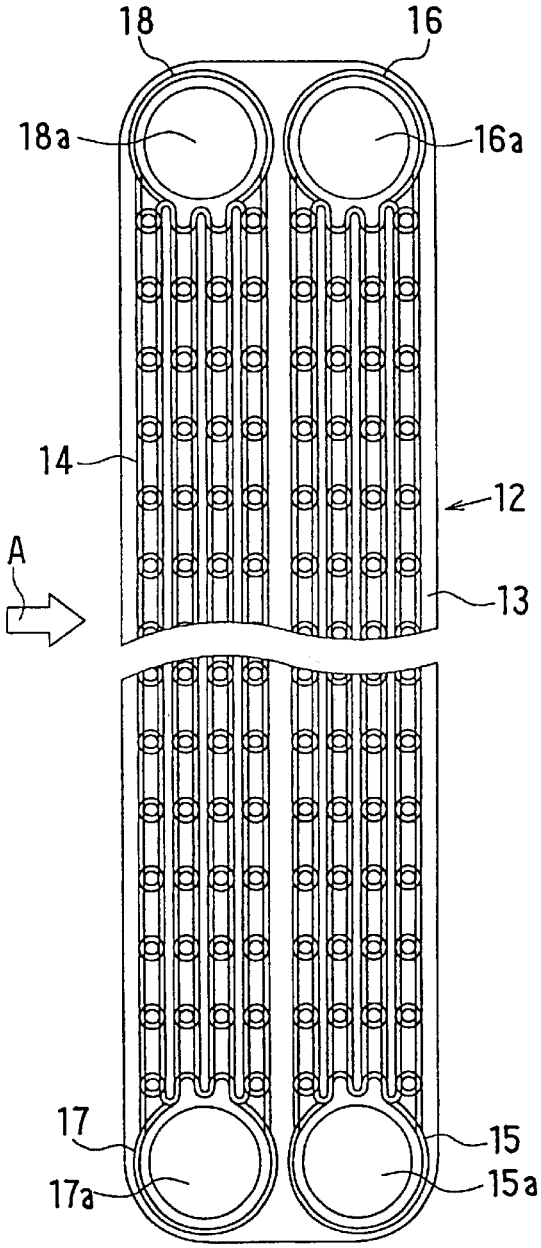
FIG. 10 is a plan view showing a pair of heat conductive plates connected to each other in the third embodiment.

According to a third embodiment, as shown in FIGS. 9 and 10, the projection ribs 14 are arranged in a direction perpendicular to the air flow direction A. In other words, the projection ribs 14 are not inclined with respect to the longitudinal direction of the heat conductive plate 12, and are arranged in parallel to the longitudinal direction (refrigerant flow direction B).

Here, in the third embodiment, the projection ribs 14 are arranged staggeringly. As shown in FIG. 10, the projection ribs 14 of the pair of heat conductive plates 12 overlap and communicate with each other at the end portions thereof, and the overlapped portions form the refrigerant passages 19, 20.

Thus, in the third embodiment, the refrigerant flows in the refrigerant passages 19, 20 in the longitudinal direction of the heat conductive plates 19, 20.

Fourth Embodiment

Figure 11:
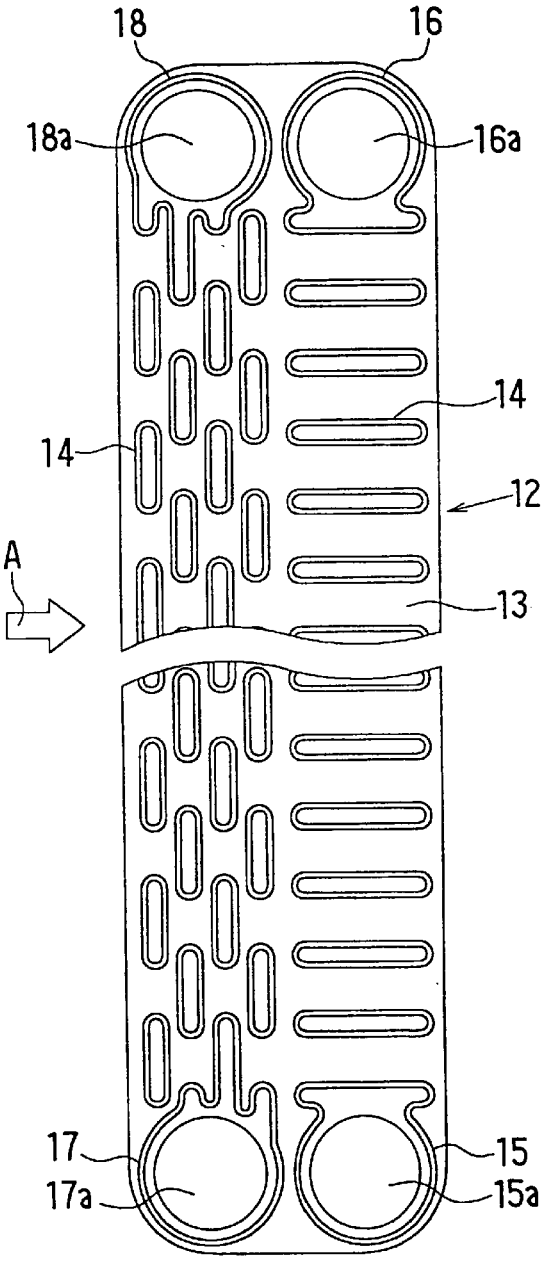
FIG. 11 is a plan view showing a heat conductive plate according to a fourth embodiment.
Figure 12:
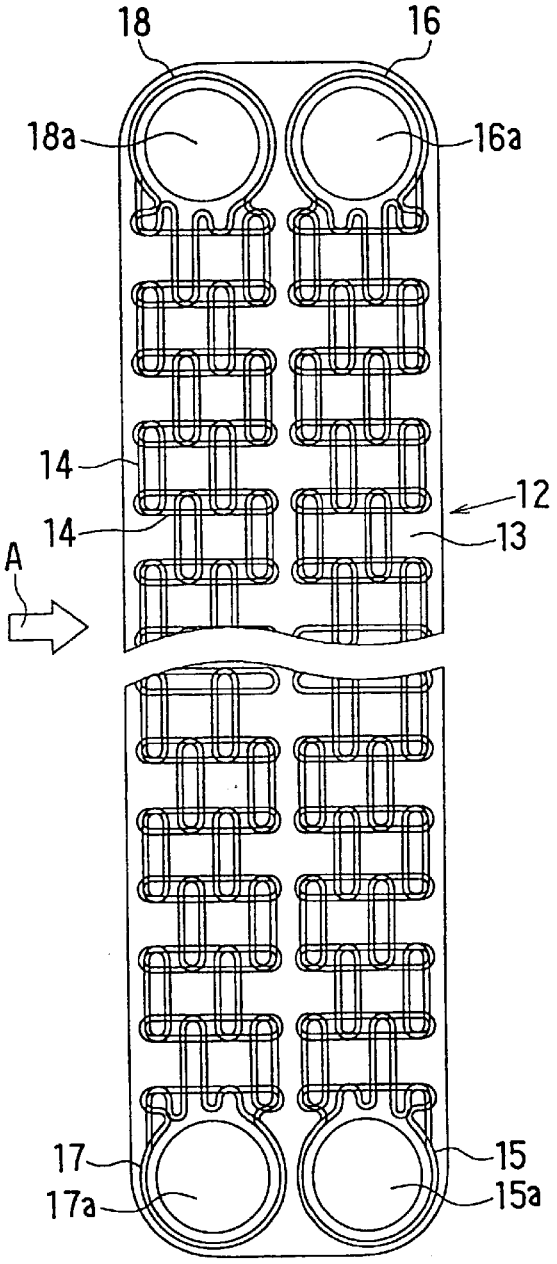
FIG. 12 is a plan view showing a pair of heat conductive plates connected to each other in the fourth embodiment.

According to a fourth embodiment, as shown in FIGS. 11 and 12, among the projection ribs 14 arranged in two rows in the air flow direction A, one side projection ribs 14 are arranged perpendicular to the air flow direction A, and the other side projection ribs 14 are arranged in parallel to the air flow direction A.

Accordingly, in the fourth embodiment, the refrigerant flows in the refrigerant passages 19, 20 while changing the flow direction alternately between the longitudinal and latitudinal directions of the heat conductive plate 12.

Fifth Embodiment

Figure 13:
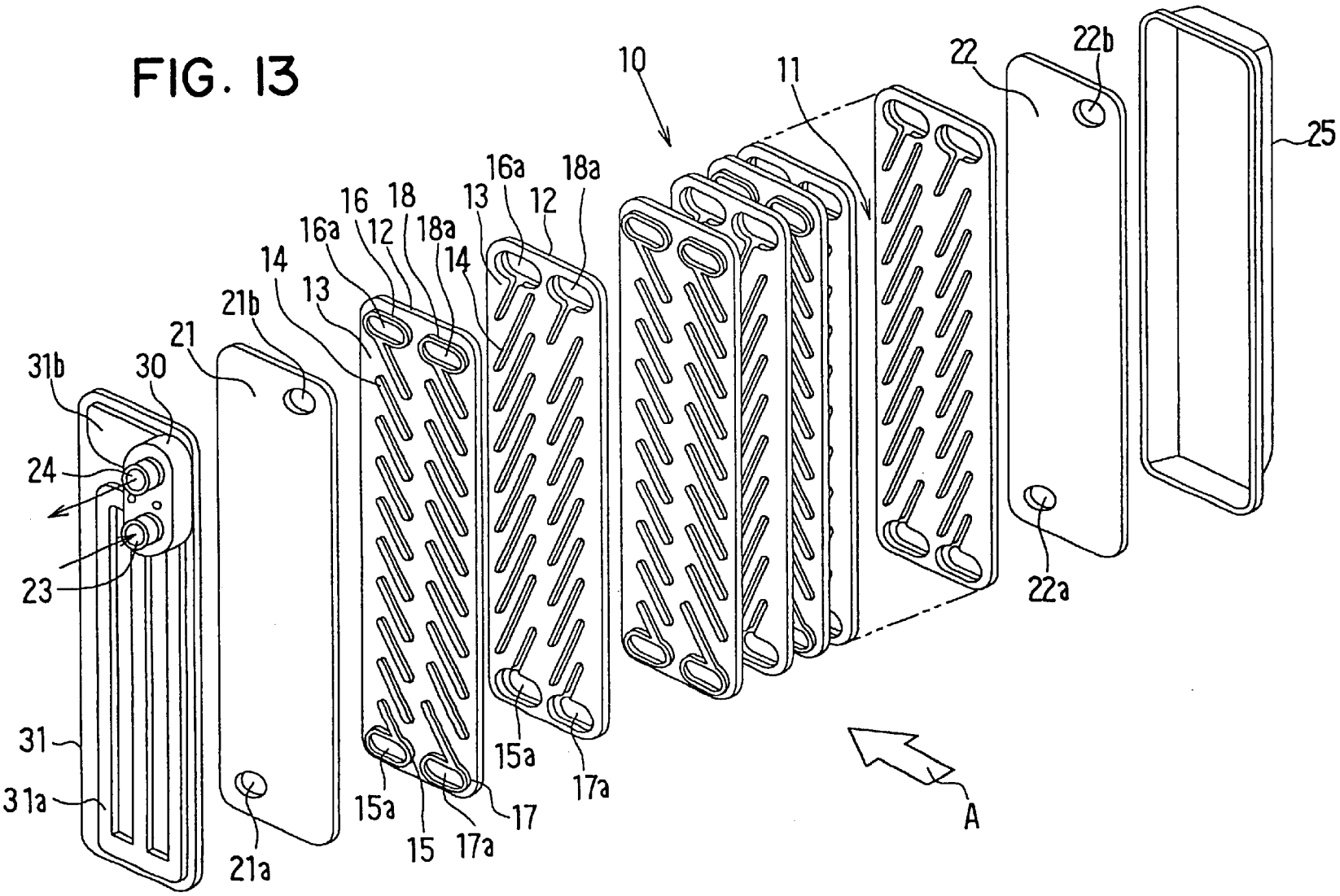
FIG. 13 is a perspective exploded view showing a refrigerant evaporator according to a fifth embodiment.

According to a fifth embodiment, as shown in FIG. 13, the air flow direction A is opposite to that in the first embodiment. In the first embodiment, the refrigerant inlet pipe 23 and the refrigerant outlet pipe 24 are independently connected to the left side end plate 21 as shown in FIG. 1. However, in the fifth embodiment, the refrigerant inlet pipe 23 and the refrigerant outlet pipe 24 are integrally formed within a single joint block 30.

Further, a side plate 31 is connected to the left side end plate 21. The side plate 31 and the end plate 21 form a refrigerant passage therebetween. This refrigerant passage communicates with the refrigerant inlet and outlet in the joint block 30. The structure of the refrigerant passage will described in more detail.

The end plate 21 has communication holes 21*a*, 21*b*. The communication hole 21*a* communicates with the communication hole 15*a* in the refrigerant inlet side lower tank portion 15. The communication hole 21*b* communicates with the communication hole 18*a* in the refrigerant outlet side upper tank portion 18.

The side plate 31 is made of an aluminum brazing sheet obtained by cladding an aluminum brazing material (A4000) on the two surfaces of an aluminum core material (A3000). The side plate 31 is thickened to about 1.0 mm for increasing the rigidity thereof.

The joint block 30 is, for example, made of an aluminum bare material (A6000), and the refrigerant inlet pipe 23 and the refrigerant outlet pipe 24 are integrated therewith. The joint block 30 is, in the fifth embodiment, disposed and connected to the upper portion of the side plate 31.

In the side plate 31, a first protrusion portion 31*a* is press-formed under the position where the joint block 30 is connected. The first protrusion portion 31*a* is bound up at both upper and lower end portions thereof, and is divided into three portions between both end portions for increasing the rigidity of the side plate 31. The inside concave portion of the first protrusion portion 31*a* forms the refrigerant passage, and the upper end of the refrigerant passage communicates with the ids refrigerant inlet pipe 23 of the joint block 30. The lower end of the refrigerant passage communicates with the communication hole 21*a* of the end plate 21.

Further, in the side plate 31, a second protrusion portion 31*b* is press-formed above the joint block 30. The inside concave portion of the protrusion portion 31*b* forms the refrigerant passage, and the lower portion of the refrigerant passage makes the refrigerant outlet pipe 24 communicate with the communication hole 21*b* of the end plate 21.

In the fifth embodiment, because the refrigerant inlet pipe 23 and the refrigerant outlet pipe 24 are integrally formed within the single joint block 30, the layout of connecting the evaporator 10 and the external refrigerant pipe is simplified.

Sixth Embodiment

In the above-described first through fifth embodiments, the heat conductive plate 12 has two tank portions 15–18 at both longitudinal ends thereof respectively. That is, the heat conductive plate 12 has totally four tank portions 15–18. The tank portions 15–18 have limited areas for heat transmitting between the air and the refrigerant.

Therefore, according to a sixth embodiment, as shown in FIGS. 14–17, only upper tank portions 16, 18 are formed at the longitudinal upper end of the heat conductive plate 12, and the lower tank portions 15, 17 are eliminated. Thereby, the heat transmitting area is maximized, and the evaporator 10 can be downsized while maintaining the cooling performance thereof.

That is, in the sixth embodiment, the projection ribs 14 are also formed in the vicinity of the lower end-of the heat conductive plate 12. Here, at the lower end portion of the heat conductive plate 12, the projection ribs 14 are formed to extend continuously from the air upstream side area to the air downstream side area in the air flow direction A. Thus a U-turn portion D (FIG. 17) is provided between the refrigerant passages 19, 20.

Figure 15:
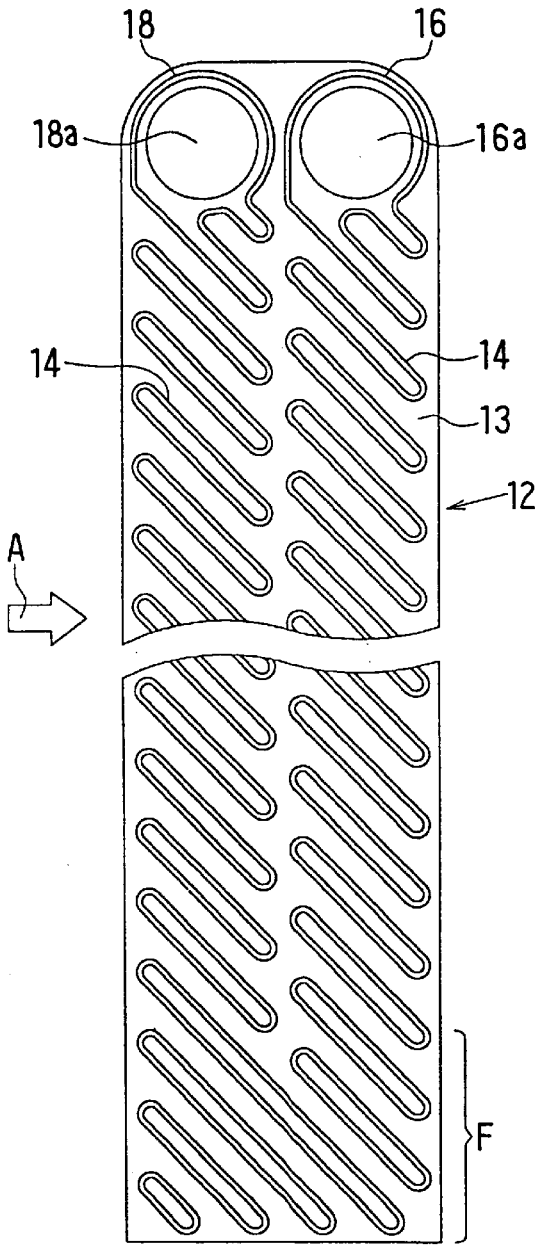
FIG. 15 is a plan view showing a heat conductive plate; according to the sixth embodiment.
Figure 16:
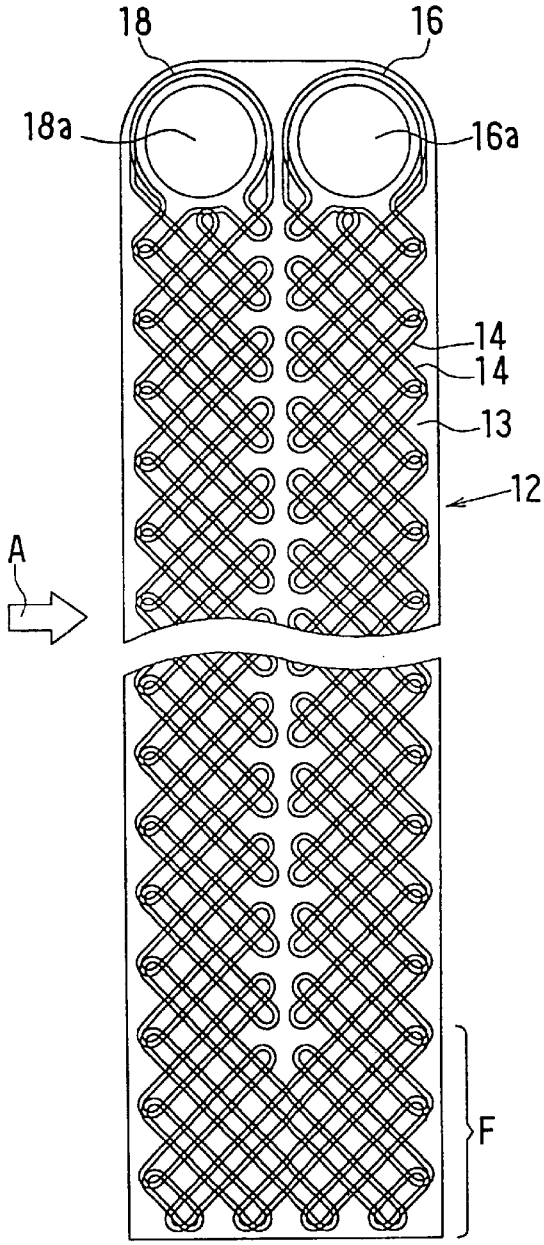
FIG. 16 is a plan view showing a pair of heat conductive plates connected to each other in the sixth embodiment.

In this way, as shown in FIGS. 15 and 16, the U-turn portion D is constructed in the lower side area F of the heat conductive plate 12.

Figure 14:
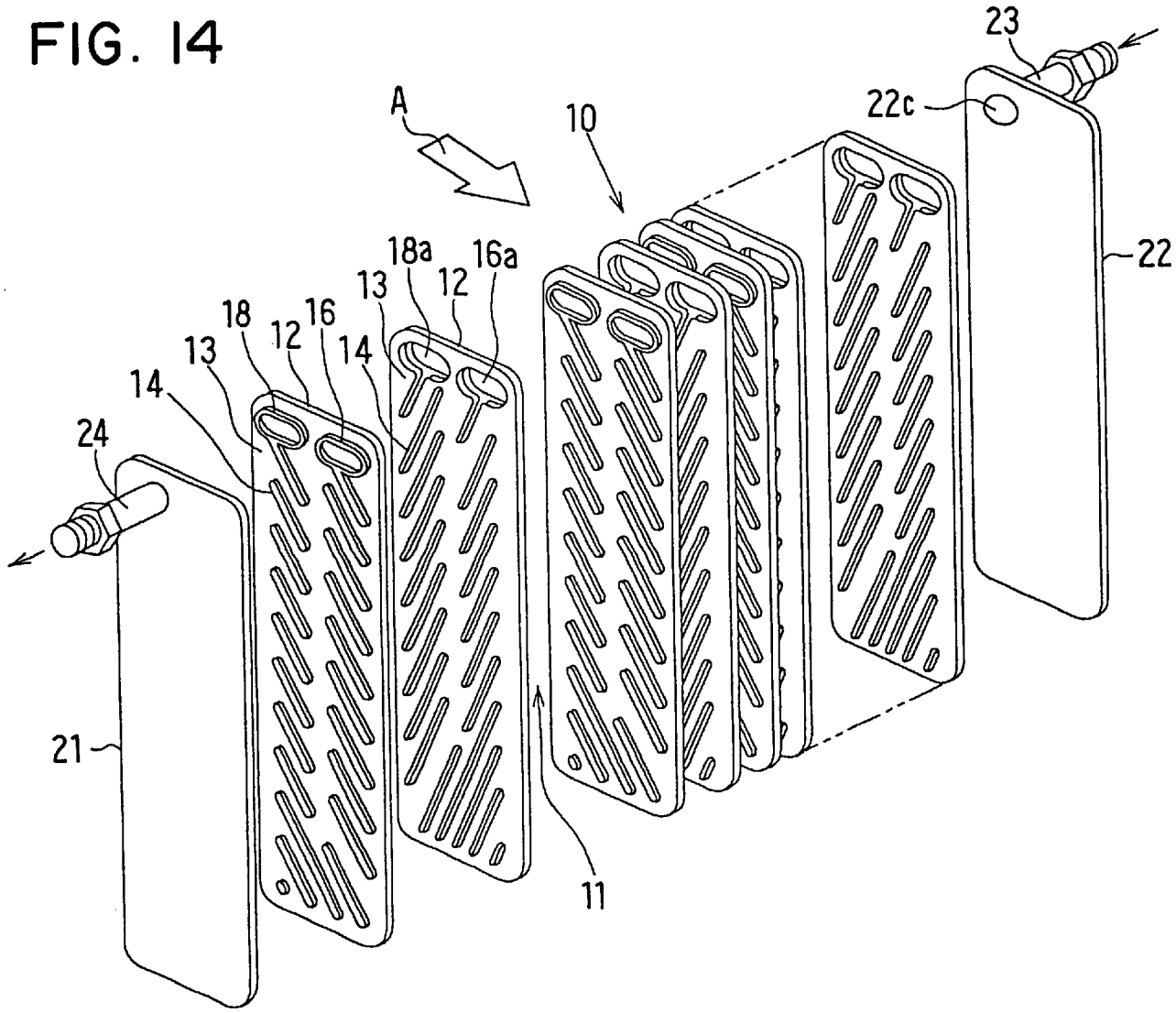
FIG. 14 is a perspective exploded view showing a refrigerant evaporator according to a sixth embodiment.

In the sixth embodiment, the refrigerant inlet pipe 23 is connected to the right side end plate 22, while the refrigerant outlet pipe 24 is connected to the left side end plate 21, as shown in FIG. 14.

The refrigerant inlet pipe 23 communicates with the right side end of the air upstream side upper tank portion 18. The refrigerant outlet pipe 24 communicates with the left side end of the air upstream side upper tank portion 18. That is, the right side end plate 22 has a communication hole 22*c* to make the refrigerant inlet pipe 23 communicate with the air upstream side upper tank portion 18. In a similar way, the left side end plate 21 has a communication hole (not illustrated) to make the refrigerant outlet pipe 24 communicate with the air upstream side upper tank portion 18.

Figure 17:
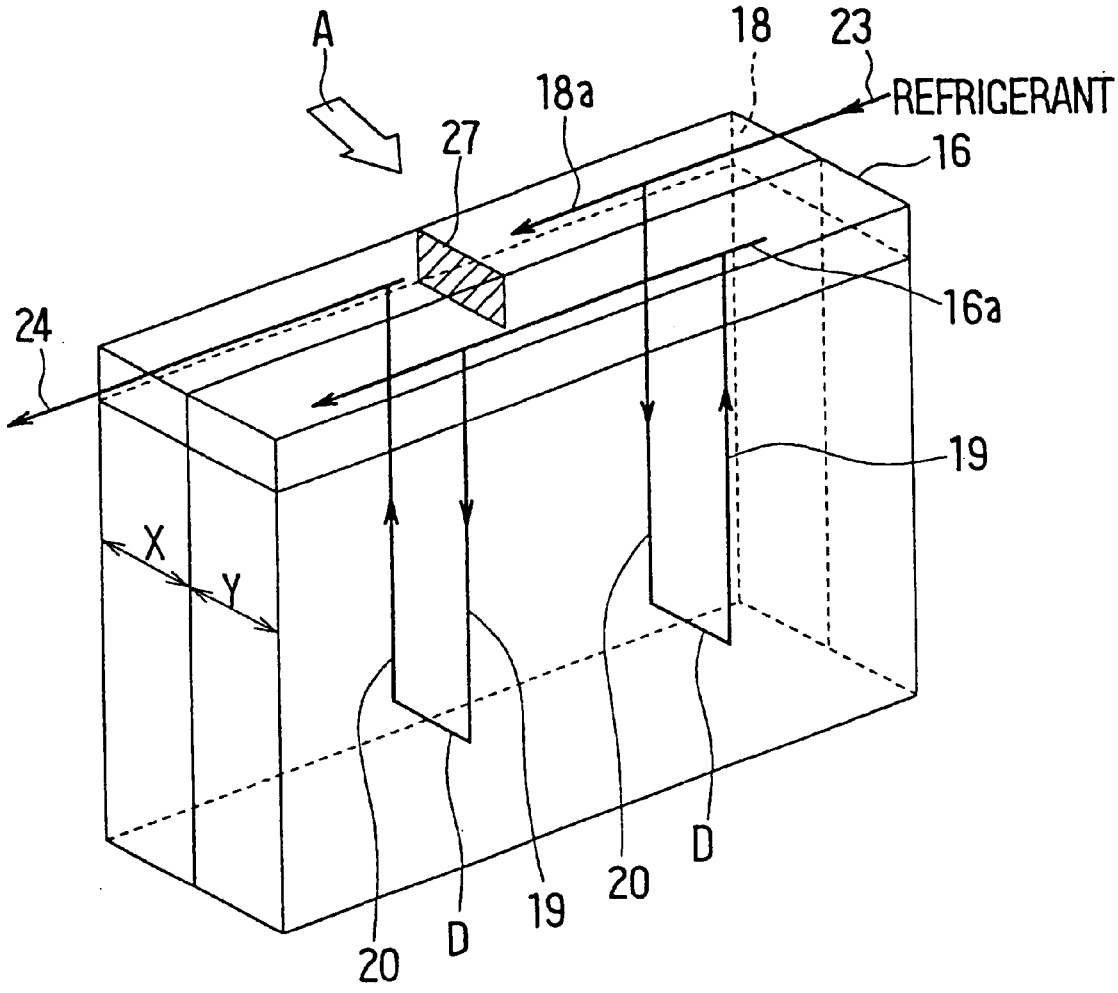
FIG. 17 is a perspective schematic view showing a layout of refrigerant passages in the sixth embodiment.

As shown in FIG. 17, a partition member 27 is provided at the center portion inside the air upstream side upper tank portion 18, for constructing the two refrigerant passages 19, 20 which U-turns in the air-flow direction A.

As shown in FIG. 16, the U-turn portion D is constructed by the projection ribs 14 which are formed in the lower side area F of the heat conductive plate 12. Thus, the lower side area F performs as the heat exchanging area the heat transmitting efficiency of which is high due to the turbulent flow of the air.

Seventh Embodiment

Figure 18:
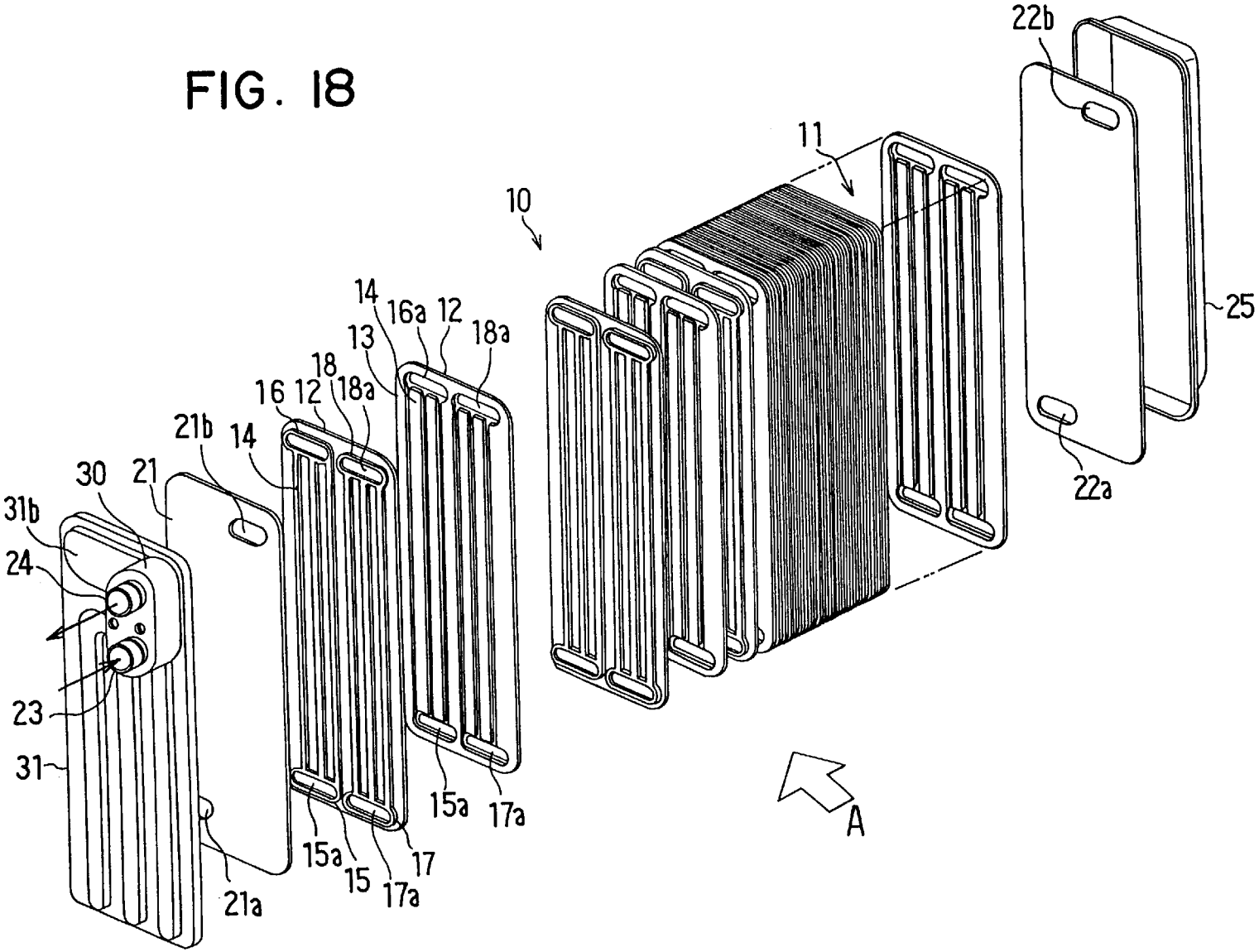
FIG. 18 is a perspective exploded view showing a refrigerant evaporator according to a seventh embodiment.
Figure 19:
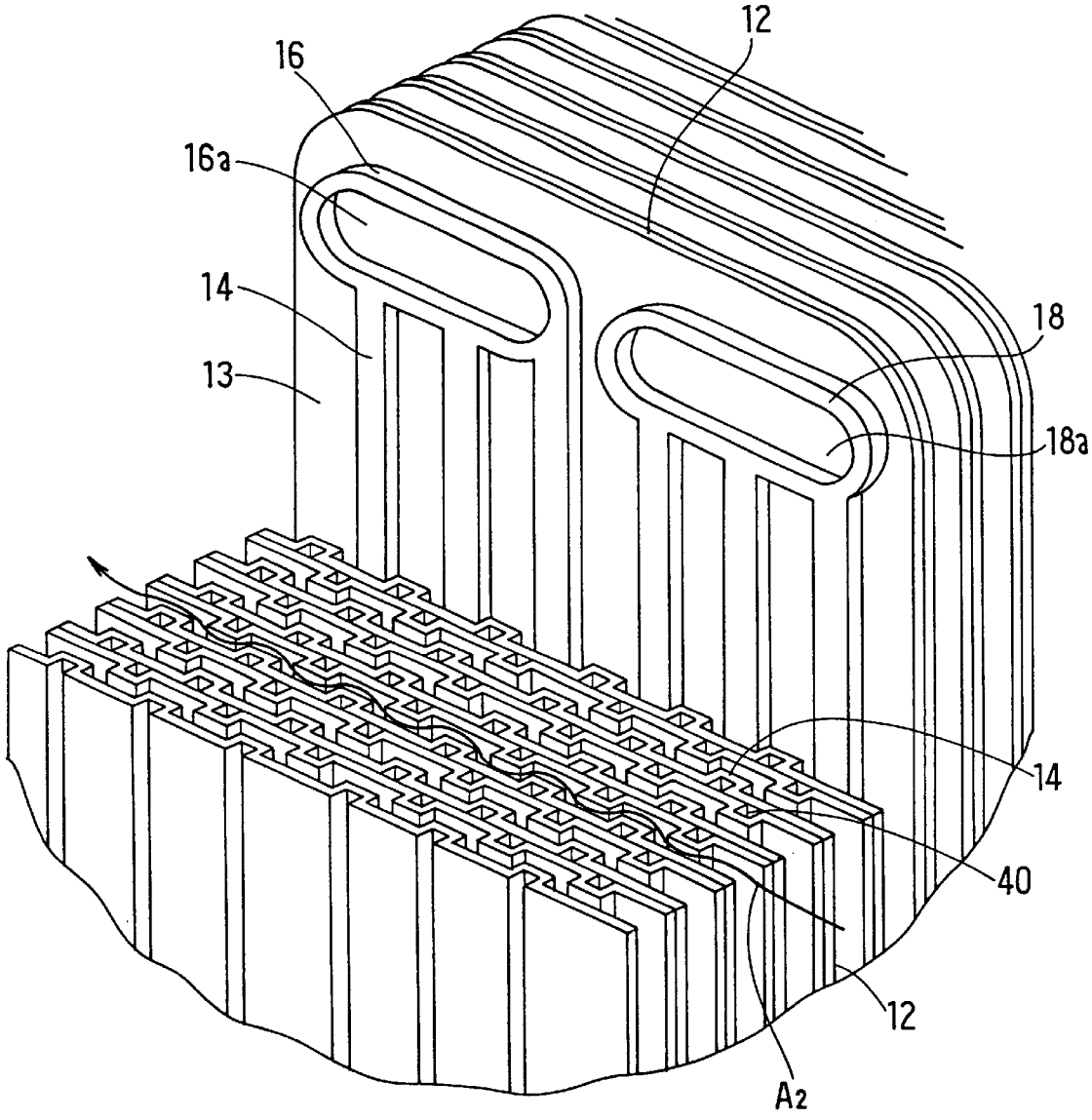
FIG. 19 is a perspective principal view showing a detailed structure of an evaporator core portion in the seventh embodiment.

According to a seventh embodiment, as shown in FIGS. 18 and 19, the projection ribs 14 are arranged in parallel to the longitudinal direction of the heat conductive plate 12, and extends straightly. The pair of plates 12 are connected to each other at the flat plate 13 thereof, and the inside of the projection rib 14 and the inside surface of the flat plate 13 form a refrigerant passage 40. The projection ribs 14 of the pair of plate 12 are arranged staggeringly, or do not overlap and communicate with each other. That is, as shown in FIG. 19, the projection ribs 14 of one heat conductive plate 12 are disposed between the adjacent projection ribs 14 of the next heat conductive plate 12 being adjacent to this one heat conductive plate 12. Here, the top outside surfaces of the projection ribs 14 of the one heat conductive plate 12 do not contact the outside surface of the flat plate 13 of the next heat conductive plate 12. In other words, there exists a space between the outside top surface of the projection ribs 14 and the outside surface of the flat plate 13 of the next heat conductive plate 12. Here, the adjacent pairs of plates contact and are brazed with each other at the only tank portions 15–18.

The refrigerant flows in the refrigerant passage 40 upwardly or downwardly, while the air winds and flows in a circuitous route between the adjacent pair of plates 12 as denoted by an arrow A2 in FIG. 19. In this way, the air makes a turbulent flow, thus the air side heat transmitting efficiency is improved.

Figure 20:
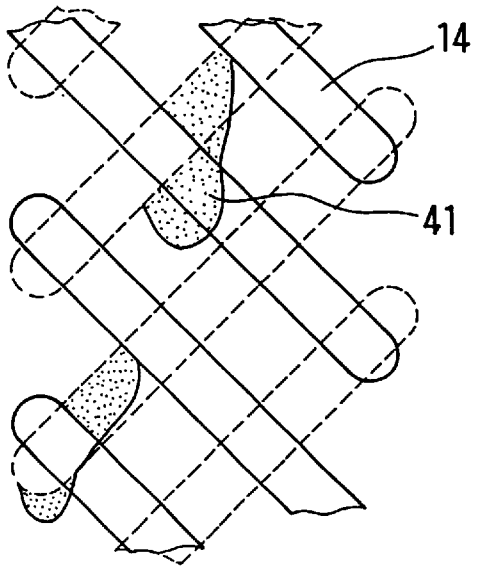
FIG. 20 is a schematic enlarged view showing a phenomena that drain water is stored at intersections of cross-ribs.
Figure 21:
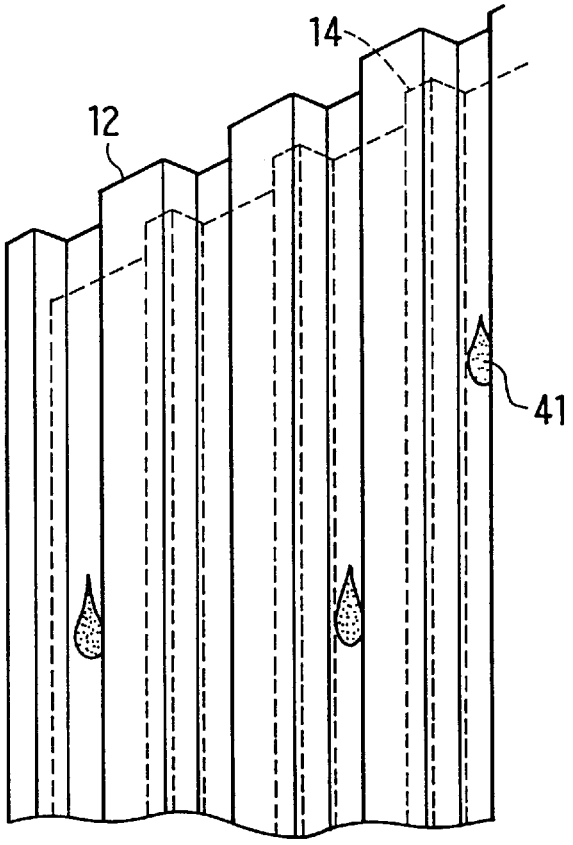
FIG. 21 is a schematic enlarged view showing a phenomena that drain water flows down straightly along projection ribs in the seventh embodiment.

In the first embodiment, the projection ribs 14 of each plate 12 are inclined to the opposite direction to intersect each other. Therefore, as shown in FIG. 20, drain water 41 is stored at the intersections of the projection ribs 14, and causes an air flow resistance to increase, thereby lessening the cooling performance of the evaporator 10. However, in the seventh embodiment, as the top outside surface of the projection ribs 14 do not contact the outside surface of the flat plate 13 of the next heat conductive plate 12, contacting portions between the adjacent heat conductive plate 12 are not formed. Thereby, as shown in FIG. 21, the drain water 41 flows down along the top outside surface of the projection ribs 14, and is not stored in the core portion 11.

Eighth Embodiment

Figure 22:
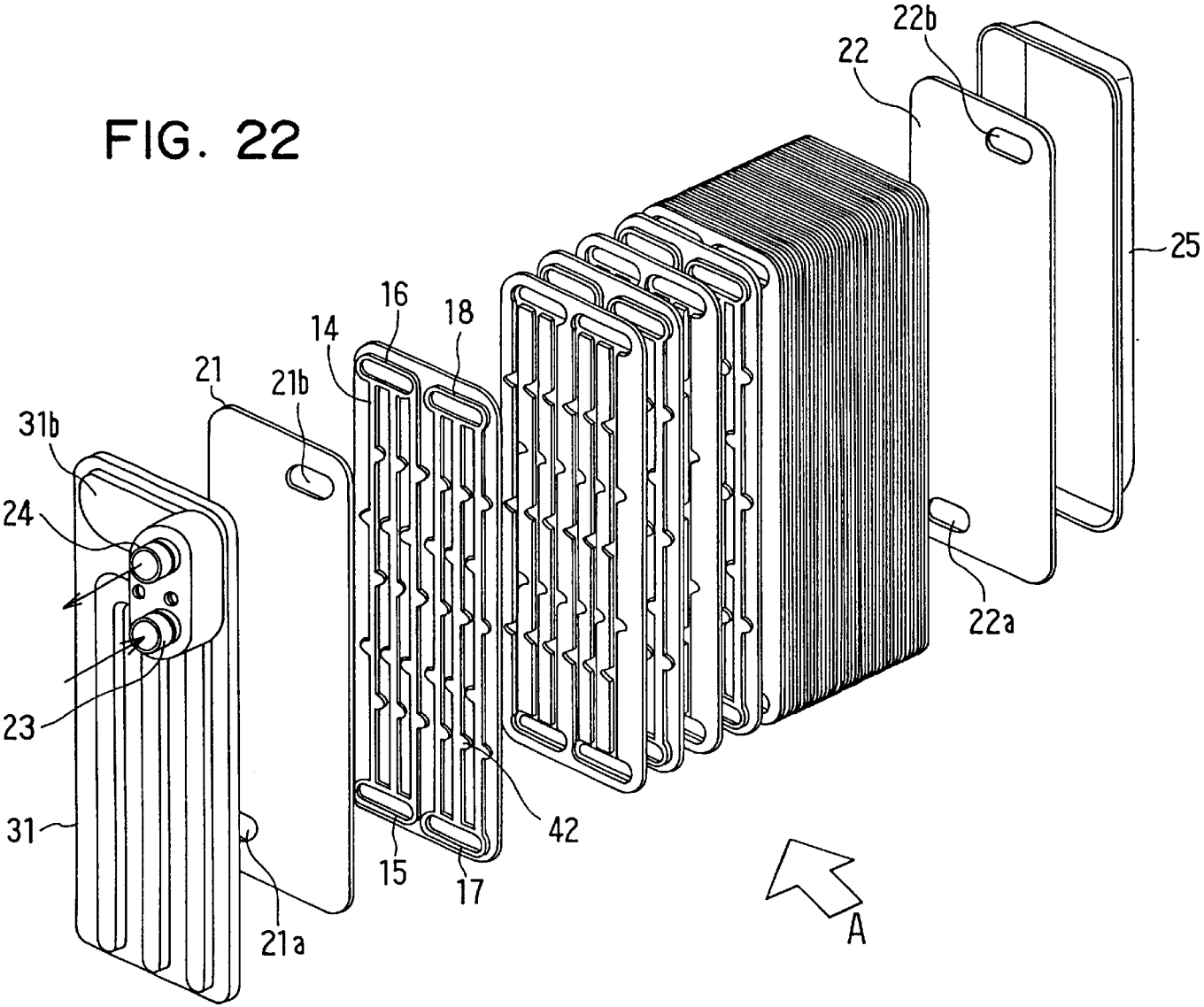
FIG. 22 is a perspective exploded view showing a refrigerant evaporator according to an eighth embodiment.
Figure 23:
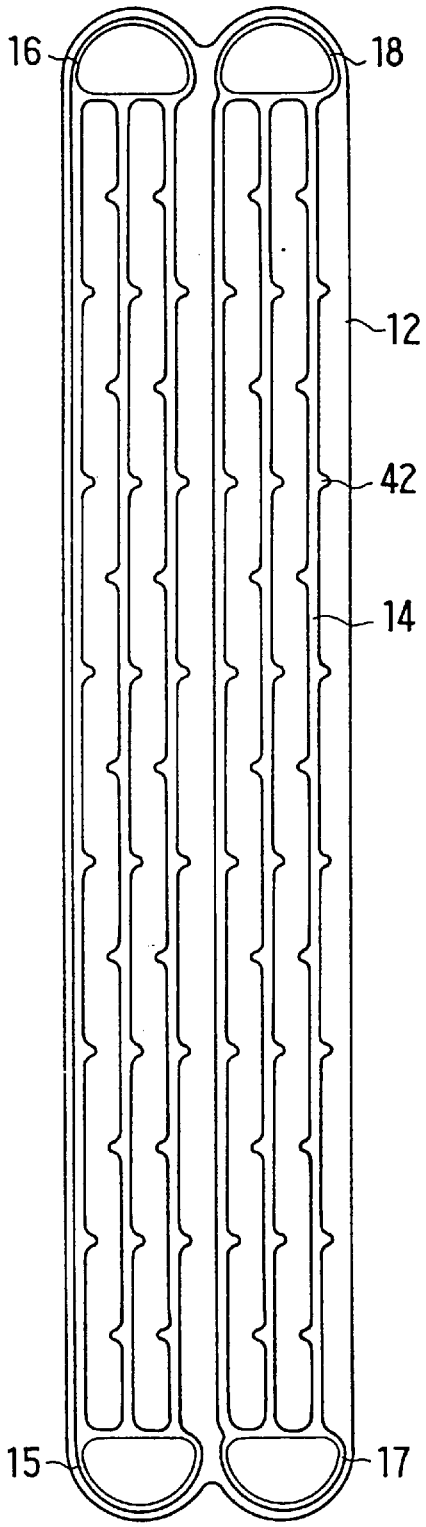
FIG. 23 is a plan view showing a heat conductive plate according to the eighth embodiment.
Figure 24:
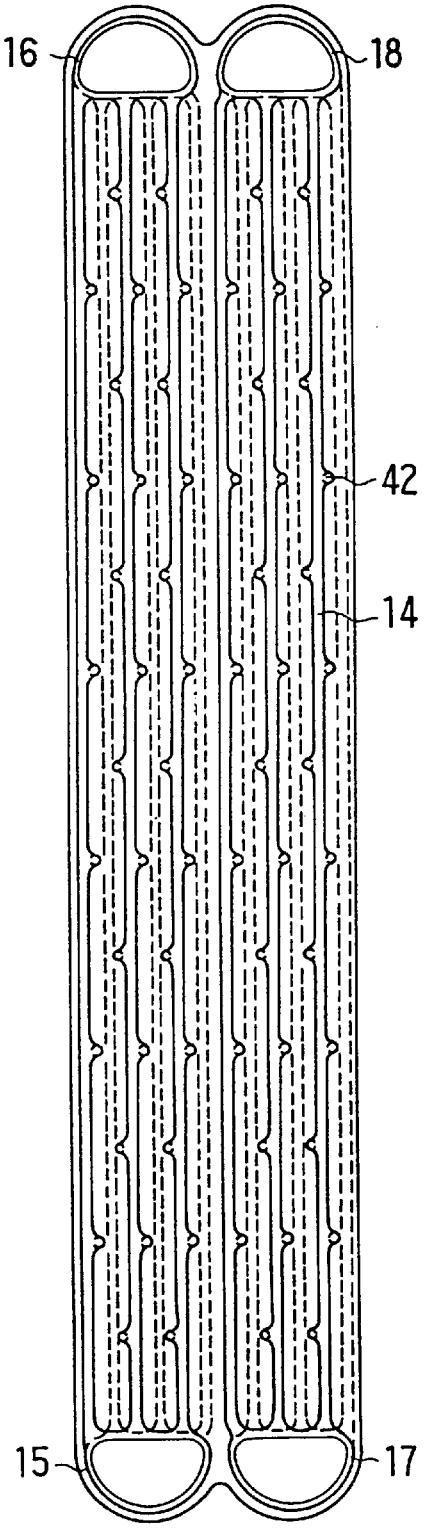
FIG. 24 is a plan view showing a pair of heat conductive plates connected to each other in the eighth embodiment.

According to an eighth embodiment, as shown in FIGS. 22–24, the projection ribs 14 have plural contacting potions 42. These contacting portions 42 are formed at the air upstream and downstream side of the projection ribs 14 alternately. As shown in FIG. 24, the contacting portions 42 of the pair of heat conductive plates 12 contact each other when the pair of plates are connected to each other. Thus, the refrigerant passages 40 formed inside the projection ribs 14 communicate with each other at the contacting points between these contacting portions 42.

In the seventh embodiment, the adjacent pairs of heat conductive plates 12 contact and are brazed with each other at the only tank portions 15–17. However, in the eighth embodiment, the adjacent pairs of plates 12 contact and brazed with each other not only at the tank portions 15–18, but also at the plural contacting portions 42. Thereby, the connecting rigidity of the entire evaporator 10 is more increased in comparison with that in the seventh embodiment.

Ninth Embodiment

Figure 25:
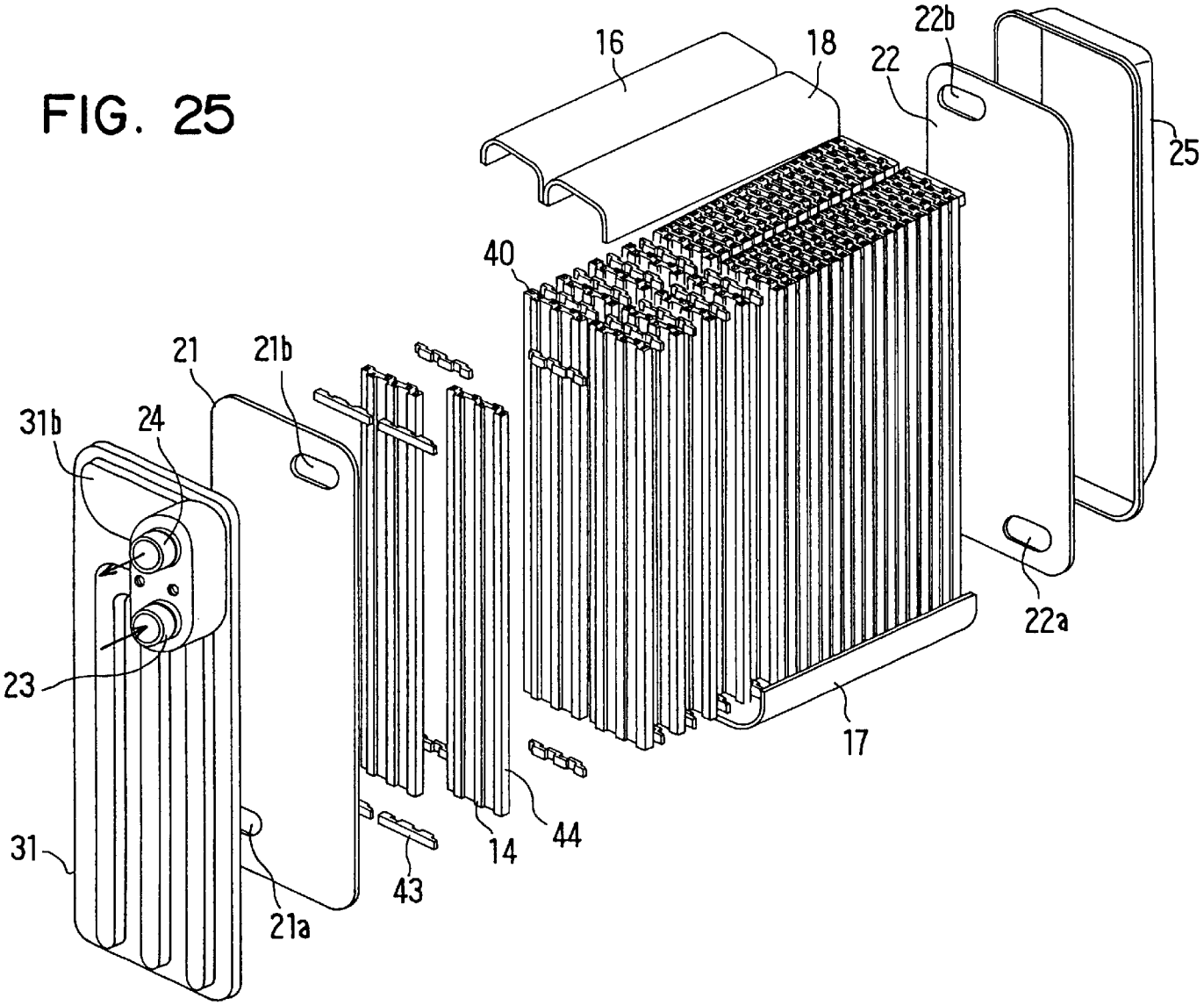
FIG. 25 is a perspective exploded view showing a refrigerant evaporator according to a ninth embodiment.
Figure 26:
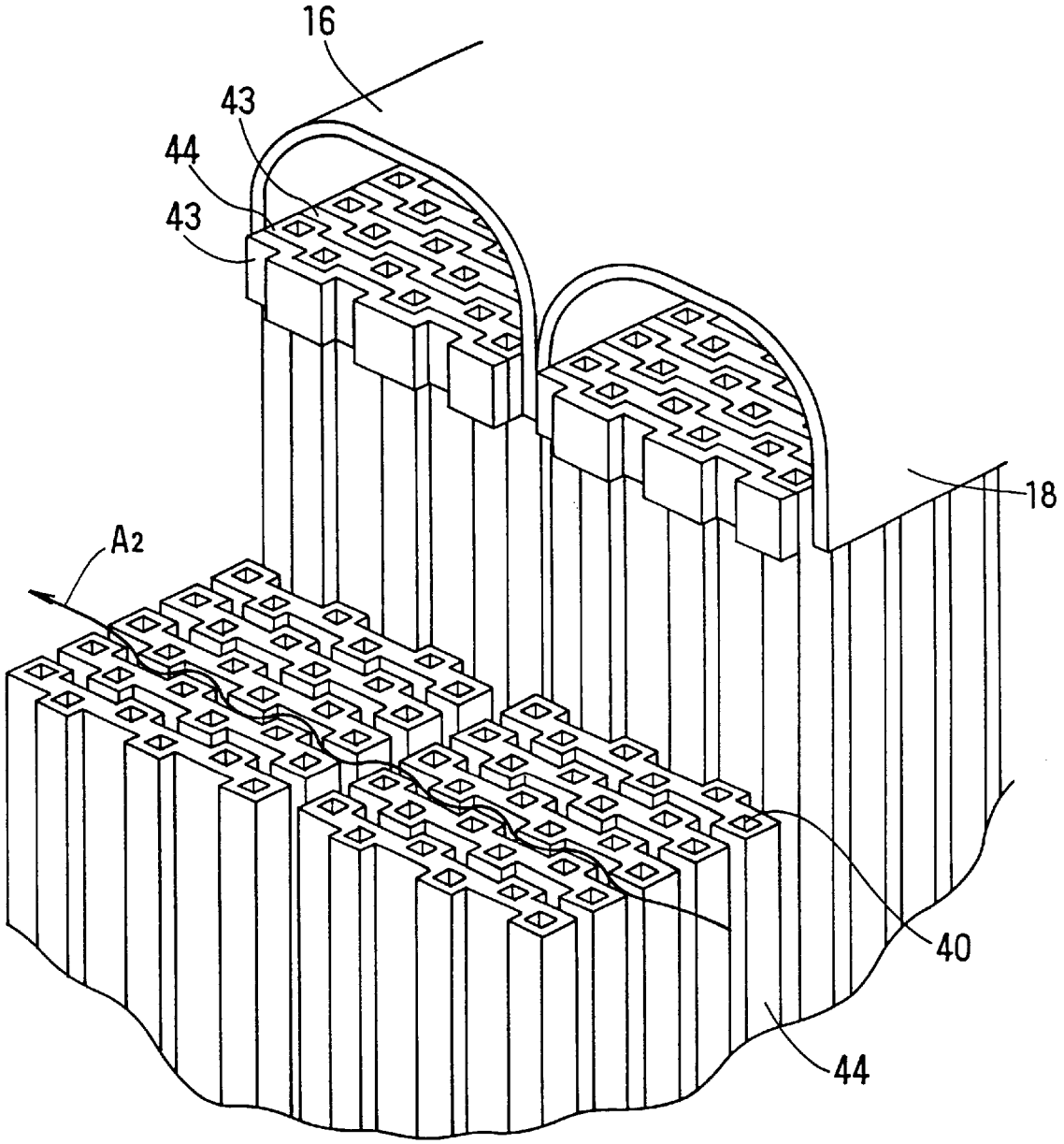
FIG. 26 is a perspective principal view showing a detailed structure of an evaporator core portion in the ninth embodiment.

According to a ninth embodiment, as shown in FIGS. 25 and 26, the refrigerant passage 40 are constructed by extruded tubes 44 formed by extruding plate materials having concave and convex portions. The evaporator core portion 11 is formed by laminating the plural extruded tubes 44 and spacers 43 having concave and convex portions alternately. That is, the spacers 43 are disposed between the adjacent extruded tubes 44 for forming air passages, thus the air winds and flows between the adjacent extruded tubes 44 as denoted by an arrow A2 in FIG. 26. Here, in the ninth embodiment, four cover portions 15–18 are provided at both ends of the extruded tubes 44 for forming tank potions 15–18. Each cover portion 15–18 extends in the laminating direction of the extruded tubes 44 and spacers 43.

In this way, the air makes a turbulent flow, thus the air side heat transmitting efficiency is improved as in the seventh embodiment.

Further as in the seventh embodiment, because the top outside surface of the convex portions of the extruded tube 43 do not contact the outside surface of the concave portions of the next extruded tube 43 by disposing the spacer 43, the drain water 41 flows down straightly along the top outside surface of the convex portions of the extruded tube 43, and is not stored in the core portion 11.

Tenth Embodiment

Figure 27:
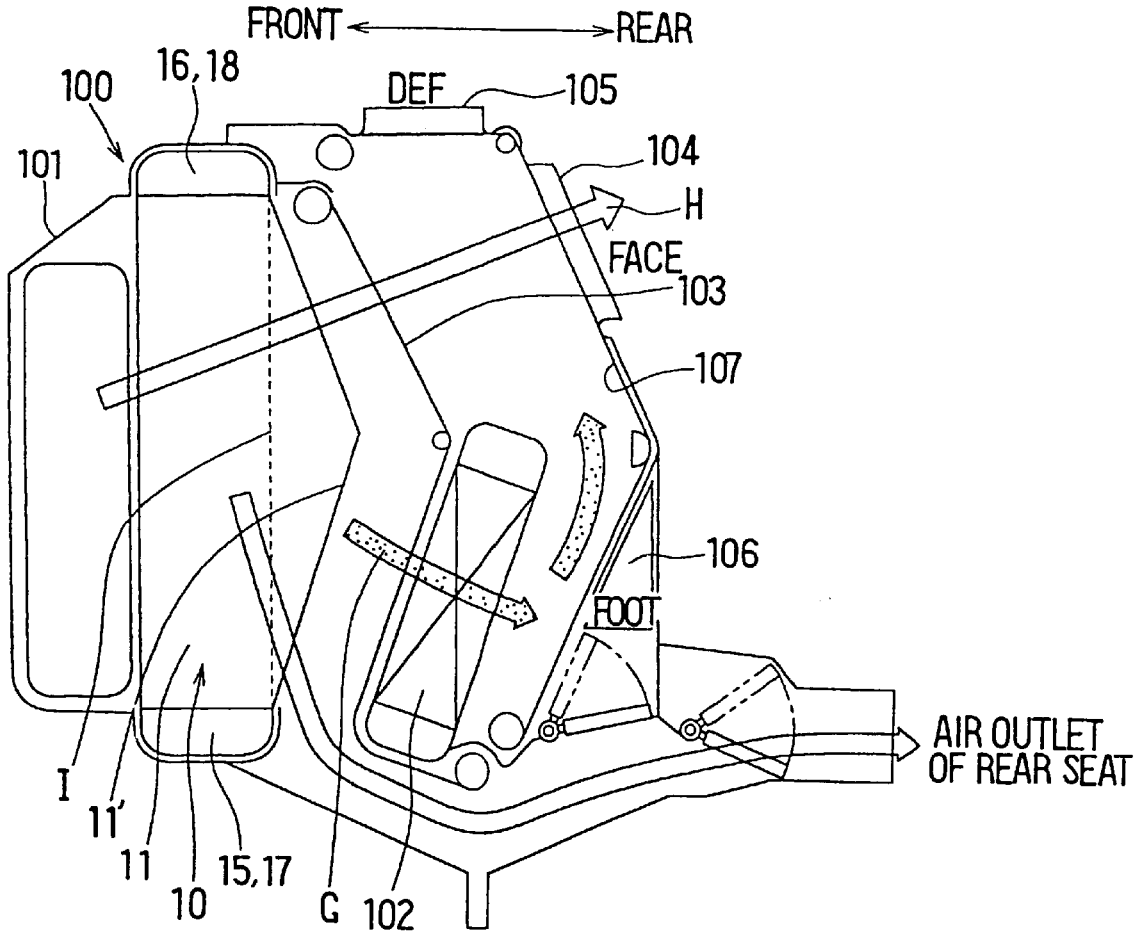
FIG. 27 is a cross sectional view showing a vehicle air conditioning unit according to a tenth embodiment.

According to a tenth embodiment, as shown in FIG. 27, the evaporator 10 is formed into a shape other than rectangular parallelopiped by using the feature of the present invention in which the fin members do not need to be provided at the air side.

The refrigerant evaporator 10 and a heater core 102 are provided in an air conditioner casing 101. The evaporator 10 performs as a cooling heat exchanger, and the heater core 102 performs as a heating heat exchanger. An air-mixing film door 103 adjust a mixing ratio of a hot air G having passed through the heater core 102 and a cooling air H having bypassed the heater core 102, and control the temperature of air blown from a face air outlet and a defroster air outlet.

A blower mode changing film door 107 changes the air-flow between into a face air outlet 104, a defroster air outlet 105, and a foot air outlet 106.

In the present invention, because the fin member such as a corrugated fin is not needed, the evaporator 10 can be formed the shape being along the inside wall of the air conditioner casing 101. Thus, the inside space of the air conditioner casing 101 is efficiently used for improving the cooling performance of the evaporator 10.

The above feature will be described with reference to FIG. 27. There exists a large space at the air upstream side of the air-mixing film door 103. For using this space efficiently, the core portion 11 of the evaporator 10 protrudes triangularly toward air downstream side (air-mixing film door 103 side). Here, numeral 11' denotes the triangular protrusion portion.

Figure 28:
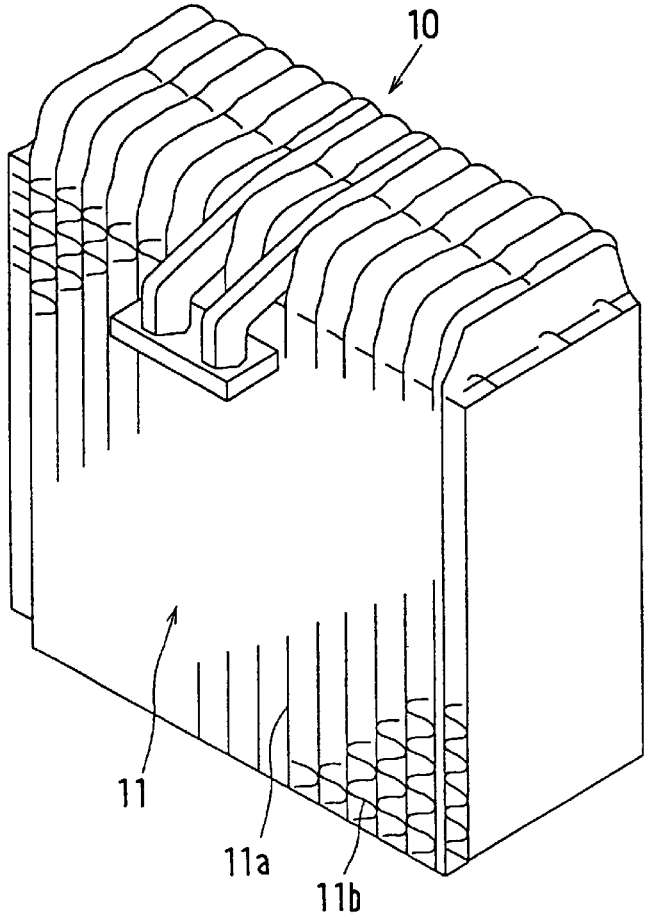
FIG. 28 PRIOR ART
FIG. 28 is a perspective view showing a conventional refrigerant evaporator.
Figure 29A:
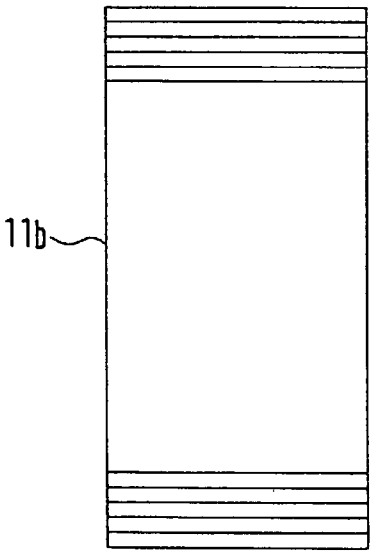
FIG. 29A PRIOR ART
FIG. 29A is a front view showing a corrugated installed into the conventional evaporator.
Figure 29B:
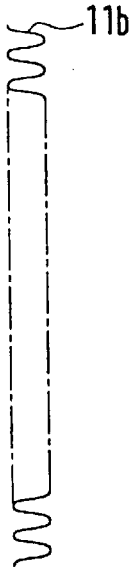
FIG. 29B PRIOR ART
FIG. 29B is a side view showing a corrugated fin installed into the conventional evaporator.

When the conventional evaporator 10 shown in FIG. 28 is installed, the volume of the space where the evaporator 10 is disposed is made small as denoted by a broken line I in FIG. 27. However, in the tenth embodiment, the volume of the evaporator core portion 11 is increased by the triangular protrusion portion 11', thereby improving the cooling performance of the evaporator 10.

Modifications

In the above-described embodiments, the heat exchanger of the present invention is applied to the refrigerant evaporator 10 in which the refrigerant flows in the refrigerant passages (inside fluid passages) 19, 20 formed in the heat conductive plate 23. However, the heat exchanger is not limited to be applied to the above-described evaporator 10, and may be applied to other heat exchangers such as a refrigerant condenser, a vehicle oil cooler and the like instead.

What is claimed is:

1. An evaporator for carrying out a heat exchange between an inside fluid and an outside fluid comprising:

a pair of heat conductive plates extending in an approximately vertical direction and each having a first plurality of projection ribs aligned in a first row and a second plurality of projection ribs aligned in a second row, a flat section being disposed between said first and second rows, said flat section extending over substantially the entire length of each of said heat conductive plates, said pair of heat conductive plates facing each other in such manner that said first and second plurality of projection ribs protrude outwardly from each of said pair of heat conductive plates for forming inside fluid passages through which the inside fluid flows therebetween, wherein:

said first and second plurality of projection ribs cooperate with a first and a second plurality of projection ribs, respectively, on adjacent heat conductive plates to form first and second outside fluid passages through which the outside fluid flows, said first and second outside fluid passages being defined only by said heat conductive plates, said projection ribs causing said outside fluid to make a turbulent flow through said first and second outside fluid passages, said projection ribs are arranged for crossing with respect to a flow direction of the outside fluid, said first and second rows are arranged in the flow direction of the outside fluid and said projection ribs are disposed at an acute angle to the flow direction of the outside fluid; and a plurality of the pairs of heat conductive plates are stacked to form a heat-exchanging core portion, each of said heat conductive plate includes tank portions having communication holes at both ends thereof in a flow direction of the inside fluid, and said tank portions make said inside fluid passages in each pair of heat conductive plates communicate with each other.

2. An evaporator according to claim 1, wherein said inside fluid passages are divided into two inside fluid passage groups in a flow direction of the outside fluid, and said tank portions are formed at both ends of said heat conductive plates for corresponding to said inside fluid passage groups respectively.

3. An evaporator for carrying out a heat exchange between an inside fluid and an outside fluid comprising:

a pair of heat conductive plates each having a first plurality of projection ribs aligned in a first row and a second plurality of projection ribs aligned in a second row, a flat section being disposed between said first and second rows, said flat section extending over substantially the entire length of each of said heat conductive plates, said pair of heat conductive plates facing each other in such manner that said first and second plurality of projection ribs protrude outwardly from each of said pair of heat conductive plates for forming inside fluid passages through which the inside fluid flows therebetween, wherein:

said plates being generally vertically disposed for causing condensation formed on outer surfaces of said plates to flow downward due to said generally vertical positioning, said first and second plurality of projection ribs cooperate with a first and a second plurality of projection ribs, respectively, on adjacent heat conductive plates to form first and second outside fluid passage through which the outside fluid flows, said first and second outside fluid passages being defined by only said heat conductive plates, said projection ribs causing said outside fluid to make a turbulent flow through said first and second outside fluid passages, and said first and second plurality of projection ribs being disposed at an acute angle relative to the flow direction of the outside fluid;

a plurality of the pairs of heat conductive plates are stacked to form a heat-exchanging core portion, each of said heat conductive plate includes tank portions having communication holes at both ends thereof in a flow direction of the inside fluid, and said tank portions make said inside fluid passages in each pair of heat conductive plates communicate with each other.

4. An evaporater according to claim 3, wherein said inside fluid passages are divided into two inside fluid passage groups in a flow direction of the outside fluid, and said tank portions are formed at both ends of said heat conductive plates for corresponding to said inside fluid passage groups respectively.

5. An evaporator for carrying out a heat exchange between an inside fluid and an outside fluid comprising:

a pair of heat conductive plates extending in an approximately vertical direction and each having a first plurality of projection ribs aligned in a first row and a second plurality of projection ribs aligned in a second row, a flat section being disposed between said first and second rows, said flat section extending over substantially the entire length of each of said heat conductive plates, said pair of heat conductive plates facing each other in such manner that said first and second plurality of projection ribs protrude outwardly from each of said pair of heat conductive plates for forming inside fluid passages through which the inside fluid flows therebetween, wherein:

said first and second plurality of projection ribs cooperate with a first and a second plurality of projection ribs, respectively, on adjacent heat conductive plates to form first and second outside fluid passages through which the outside fluid flows, said first and second outside fluid passages being defined only by said heat conductive plates, said projection ribs causing said outside fluid to make a turbulent flow through said first and second out side fluid passages, said projection ribs are arranged for crossing with respect to a flow direction of the outside fluid, said first and second rows are arranged in the flow direction of the outside fluid and said projection ribs are disposed at an acute angle to the flow direction of the outside fluid; and said projection ribs in said first row are tilted in a tilt direction which is opposite to that of said projection ribs in said second row.

* * * * *